US008249485B2

(12) United States Patent
Horikawa et al.

(10) Patent No.: US 8,249,485 B2
(45) Date of Patent: Aug. 21, 2012

(54) PROCESS CARTRIDGE WITH PORTIONS TO BE SUPPORTED AND REGULATED DURING INSERTION OF THE CARTRIDGE INTO AN ELECTROPHOTOGRAPHIC IMAGE FORMING APPARATUS

(75) Inventors: Tadashi Horikawa, Numazu (JP); Tachio Kawai, Odawara (JP); Hiroshi Takarada, Gotemba (JP); Takashi Nakanishi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 711 days.

(21) Appl. No.: 12/168,539

(22) Filed: Jul. 7, 2008

(65) Prior Publication Data

US 2009/0290903 A1 Nov. 26, 2009

(30) Foreign Application Priority Data

May 23, 2008 (JP) ..... 2008-135017

(51) Int. Cl.
*G03G 21/18* (2006.01)

(52) U.S. Cl. ..... 399/111

(58) Field of Classification Search ..... 399/111–114
See application file for complete search history.

(56) References Cited

U.S. PATENT DOCUMENTS

| | | | | |
|---|---|---|---|---|
| 5,903,803 | A | 5/1999 | Kawai et al. | 399/116 |
| 6,055,406 | A | 4/2000 | Kawai et al. | 399/360 |
| 6,115,567 | A | 9/2000 | Kawai et al. | 399/106 |
| 6,128,454 | A | 10/2000 | Kawai et al. | 399/116 |
| 6,163,665 | A | 12/2000 | Watanabe et al. | 399/111 |
| 6,175,706 | B1 | 1/2001 | Watanabe et al. | 399/167 |
| 6,226,478 | B1 | 5/2001 | Watanabe et al. | 399/117 |
| 6,240,266 | B1 | 5/2001 | Watanabe et al. | 399/117 |

(Continued)

FOREIGN PATENT DOCUMENTS

JP 2004-177525 6/2004

(Continued)

OTHER PUBLICATIONS

PCT International Search Report and Written Opinion of International Search Authority in PCT/JP2008/063218 issued Oct. 13, 2008.

(Continued)

*Primary Examiner* — Walter L Lindsay, Jr.
*Assistant Examiner* — Ruth Labombard
(74) *Attorney, Agent, or Firm* — Fitzpatrick, Cella, Harper & Scinto

(57) ABSTRACT

A process cartridge detachably mountable to a main assembly of an electrophotographic image forming apparatus, wherein the apparatus includes a supporting member, a movable member for moving the supporting member in a horizontal direction and upward and downward directions, an operating member for moving the movable member, and a regulating portion, the process cartridge includes an electrophotographic photosensitive drum; process means actable on the drum; a portion to be supported for being supported by the supporting member when the process cartridge is mounted to the main assembly of the apparatus; and a portion-to-be-regulated for being regulated by being contacted by the regulating portion to regulate movement of the process cartridge in the horizontal direction, when the supporting member is moved, by movement of the movable member by operation of the operating member and in the horizontal direction and the upward direction while supporting the process cartridge, wherein when the supporting member is moved in the horizontal direction and upward direction while supporting the process cartridge, the portion-to-be-supported slides on the supporting member, and the portion-to-be-regulated slides on the regulating portion.

18 Claims, 12 Drawing Sheets

U.S. PATENT DOCUMENTS

| | | | | |
|---|---|---|---|---|
| 6,336,018 | B1 | 1/2002 | Kawai et al. | 399/117 |
| 6,349,188 | B1 | 2/2002 | Kawai et al. | 399/116 |
| 6,381,430 | B1 | 4/2002 | Yokomori et al. | 399/119 |
| 6,385,416 | B1 | 5/2002 | Horikawa et al. | 399/111 |
| 6,463,232 | B1 | 10/2002 | Kawai et al. | 399/111 |
| 6,480,687 | B1 | 11/2002 | Kawai et al. | 399/111 |
| 6,496,667 | B2 | 12/2002 | Shiratori et al. | 399/103 |
| 6,501,926 | B1 | 12/2002 | Watanabe et al. | 399/117 |
| 6,501,927 | B1 | 12/2002 | Watanabe et al. | 399/117 |
| 6,560,422 | B2 | 5/2003 | Kanno et al. | 399/106 |
| 6,681,088 | B2 | 1/2004 | Kanno et al. | 399/111 |
| 6,735,403 | B2 | 5/2004 | Kanno et al. | 399/103 |
| 6,738,588 | B2 | 5/2004 | Yokomori et al. | 399/111 |
| 6,947,686 | B2 | 9/2005 | Kawai et al. | 399/111 |
| 6,968,142 | B2 | 11/2005 | Arimitsu et al. | 399/114 |
| 7,016,626 | B2 | 3/2006 | Yokomori et al. | 399/117 |
| 7,024,133 | B2 | 4/2006 | Nagashima et al. | |
| 7,027,754 | B2 | 4/2006 | Harada et al. | 399/111 |
| 7,046,942 | B2 | 5/2006 | Arimitsu et al. | 399/114 |
| 7,085,516 | B2 | 8/2006 | Kawai et al. | 399/111 |
| 7,130,560 | B2 | 10/2006 | Kawai et al. | 399/110 |
| 7,233,752 | B2 | 6/2007 | Harada et al. | 399/111 |
| 7,257,353 | B2 | 8/2007 | Kawai et al. | 399/254 |
| 7,310,489 | B2 | 12/2007 | Kawai | 399/111 |
| 7,366,440 | B2 | 4/2008 | Horikawa | 399/111 |
| 7,386,241 | B2 | 6/2008 | Mori et al. | 399/12 |
| 7,463,847 | B2 | 12/2008 | Sato | |
| 2003/0161656 | A1 | 8/2003 | Miura et al. | 399/116 |
| 2006/0140674 | A1 | 6/2006 | Sato | 399/119 |
| 2006/0285879 | A1 | 12/2006 | Yamaguchi et al. | 399/111 |
| 2007/0160386 | A1 | 7/2007 | Kawamura | 399/110 |
| 2007/0160388 | A1 | 7/2007 | Yoshimura et al. | 399/111 |
| 2007/0223970 | A1 | 9/2007 | Kawai | 399/258 |
| 2007/0237544 | A1 | 10/2007 | Kawai | 399/111 |
| 2008/0253803 | A1* | 10/2008 | Nittani et al. | 399/114 |

FOREIGN PATENT DOCUMENTS

| | | |
|---|---|---|
| JP | 2004212986 | 7/2004 |
| JP | 2005055631 | 3/2005 |
| JP | 2005070085 | 3/2005 |
| JP | 2006184553 | 7/2006 |
| JP | 2006-308771 | 11/2006 |
| JP | 2007171305 | 7/2007 |

OTHER PUBLICATIONS

English translation of Sep. 6, 2011 Office Action in Japanese Patent Application No. 2008-135017.

Office Action in Korean Patent Application No. 10-2010-7025646, dated Mar. 20, 2012.

Office Action in Chinese Patent Application No. 200880129302.1, mailed Jun. 4, 2012 (with English translation).

* cited by examiner

PROCESS CARTRIDGE WITH PORTIONS TO BE SUPPORTED AND REGULATED DURING INSERTION OF THE CARTRIDGE INTO AN ELECTROPHOTOGRAPHIC IMAGE FORMING APPARATUS

FIELD OF THE INVENTION AND RELATED ART

The present invention relates to a process cartridge detachably mountable to an apparatus main assembly of an electrophotographic image forming apparatus, and the electrophotographic image forming apparatus using the same.

Here, the electrophotographic image forming apparatus (image forming apparatus) is the device which forms the image on a recording material P using an electrophotographic image forming process. For example, it includes an electrophotographic copying machine, an electrophotographic printer (an LED printer, a laser beam printer, and so on), an electrophotographic facsimile device, an electrophotographic word processor, and so on.

Recording material P is the material on which the image is formed, and it includes a paper sheet, for example, a recording sheet, an OHP sheet, and a label.

In addition, the process cartridge is a cartridge which comprises integrally a photosensitive drum (photosensitive drum) and at least one of charging means, developing means and a cleaning means as process means, and which is detachably mountable as a unit to the image forming apparatus. For example, it is a process cartridge which comprises integrally at least developing means as the process means and a photosensitive drum, and which is detachably mountable as a unit to the image forming apparatus.

Heretofore, the structures for transferring the image formed on the photosensitive drum of the process cartridge (cartridge) onto the recording material include the structure of transferring it onto the recording material directly, and the structure of transferring it onto the recording material once it is transferred onto an intermediary transfer member. Particularly, in the case of a multicolor image forming apparatus to which a plurality of cartridges are detachably mountable, the latter can shorten the length of a feeding path of the recording material. For this reason, the structure using the intermediary transfer member is used widely.

As a kind of intermediary transfer member, there is an intermediary transfer belt which is a cylindrical transfer drum or a belt member. Inter alia, the intermediary transfer belt (transfer belt) has large latitude in an arrangement. For this reason, the transfer belt is advantageous in a space saving of the image forming apparatus.

Here, in the case of the image forming apparatus in which the transfer belt is disposed above the photosensitive drum and the cartridge is mounted and demounted in an axial direction of the photosensitive drum, the photosensitive drum and the transfer belt rotate in a mounted state of the cartridge, in contact with each other. At this time, the photosensitive drum is pressed in the upper portion thereof with a predetermined pressure, and the transfer belt is pressed with the predetermined pressure in the lower part.

On the other hand, in the photosensitive drum and the transfer belt, the images are formed on the surfaces thereof. Therefore, it is desirable for the respective surfaces not to be damaged. From this viewpoint, in the case of a cartridge mounting and demounting operations, the photosensitive drum is made to space from the transfer belt. By this, those damages are prevented (JP 2004-177525A).

With such a structure, the damage of the photosensitive drum surface and the transfer belt surface attributable to a cartridge mounting and demounting operation can be prevented.

SUMMARY OF THE INVENTION

However, as in the case of a structure disclosed in the above described publication when the structure of spacing only a photosensitive drum from a transfer belt is employed, it is necessary to move the photosensitive drum. Then, a cartridge structure is complicated and the cost rising results.

In view of this, it is a principal object of the present invention to provide a process cartridge and an electrophotographic image forming apparatus in which the whole process cartridge rises at the time of mounting a process cartridge to an apparatus main assembly.

It is another object of the present invention to provide a process cartridge and an electrophotographic image forming apparatus in which the mounting operativity in the mounting, to the apparatus main assembly, of the process cartridge is improved.

It is another object of the present invention to provide a process cartridge and an electrophotographic image forming apparatus in which the process cartridge can be mounted to the apparatus main assembly with a stable state.

It is another object of the present invention to provide a process cartridge and an electrophotographic image forming apparatus with which the reduction of the cost is accomplished.

It is another object of the present invention to provide a process cartridge and a color electrophotographic image forming apparatus in which the stabilized contact between the photosensitive drum and the transfer belt can be maintained.

According to an aspect of the present invention, there is provided a process cartridge detachably mountable to a main assembly of an electrophotographic image forming apparatus, wherein the electrophotographic image forming apparatus includes a supporting member, a movable member for moving the supporting member in a horizontal direction and upward and downward directions, an operating member for moving the movable member, and a regulating portion, said process cartridge comprising an electrophotographic photosensitive drum; process means actable on said electrophotographic photosensitive drum; a portion-to-be-supported for being supported by the supporting member when said process cartridge is mounted to the main assembly of the apparatus; and a portion-to-be-regulated for being regulated by being contacted by the regulating portion to regulate movement of said process cartridge in the horizontal direction, when the supporting member is moved, by movement of the movable member by operation of the operating member and in the horizontal direction and the upward direction while supporting said process cartridge, wherein when the supporting member is moved in the horizontal direction and upward direction while supporting said process cartridge, said portion-to-be-supported slides on the supporting member, and said portion-to-be-regulated slides on the regulating portion.

According to another aspect of the present invention, there is provided an electrophotographic image forming apparatus for forming an image on a recording material, to which apparatus a process cartridge is detachably mountable, said electrophotographic image forming apparatus comprising:

(1) a supporting member;

(2) a movable member for moving the supporting member in a horizontal direction and upward and downward directions;

(3) an operating member for moving the movable member;

(4) a regulating portion; and (5) a process cartridge including an electrophotographic photosensitive drum, process means actable on said electrophotographic photosensitive drum, a portion to be supported for being supported by the supporting member when said process cartridge is mounted to the main assembly of the apparatus, a portion-to-be-regulated for being regulated by being contacted by the regulating portion to regulate movement of said process cartridge in the horizontal direction, when the supporting member is moved, by movement of the movable member by operation of the operating member and in the horizontal direction and the upward direction while supporting said process cartridge, wherein when the supporting member is moved in the horizontal direction and upward direction while supporting said process cartridge, said portion-to-be-supported slides on the supporting member, and said portion-to-be-regulated slides on the regulating portion.

According to the present invention, in mounting the process cartridge to the apparatus main assembly, by raising the whole process cartridge, the process cartridge can be mounted to a predetermined position of the apparatus main assembly.

According to the present invention, by employing the structure of raising the whole process cartridge, the mounting operativity in the mounting, to the apparatus main assembly, of the process cartridge is improved.

According to the present invention, by employing the structure of raising the whole process cartridge, the process cartridge can stably be mounted to the apparatus main assembly.

According to the present invention, by simplifying the structure for mounting the process cartridge to the apparatus main assembly, the reduction of the cost is accomplished.

According to the present invention, by accomplishing the structure of raising whole process cartridges, the contacted state between the photosensitive drum and the transfer belt can stably be maintained.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

[Embodiment 1]

<General Structure of Image Forming Apparatus>

Figure 1:
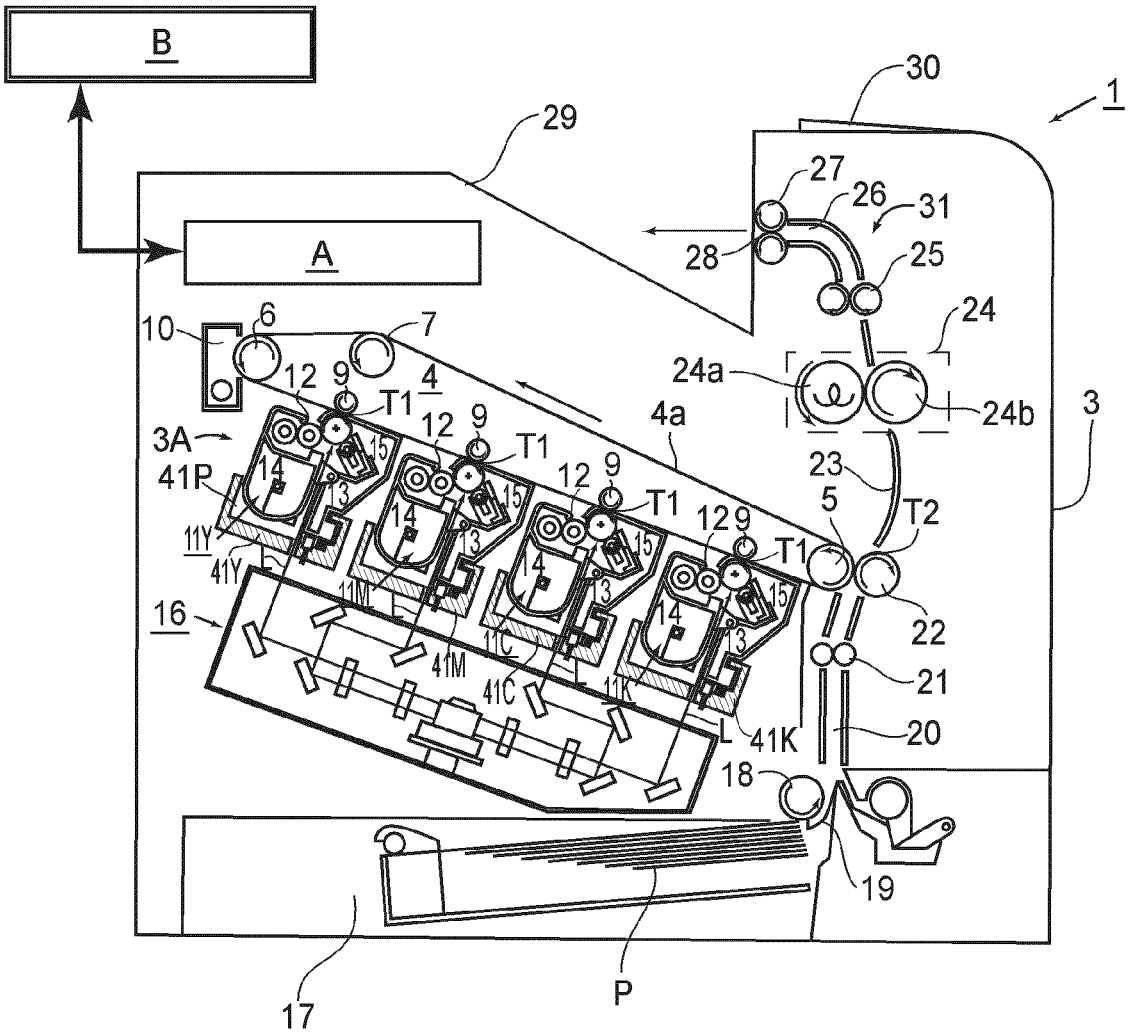
FIG. 1 is a schematic vertical sectional view of the image forming apparatus in the first embodiment of the present invention, at a plane parallel to the front panel of the image forming apparatus, when the image forming apparatus is in operation.
Figure 2:
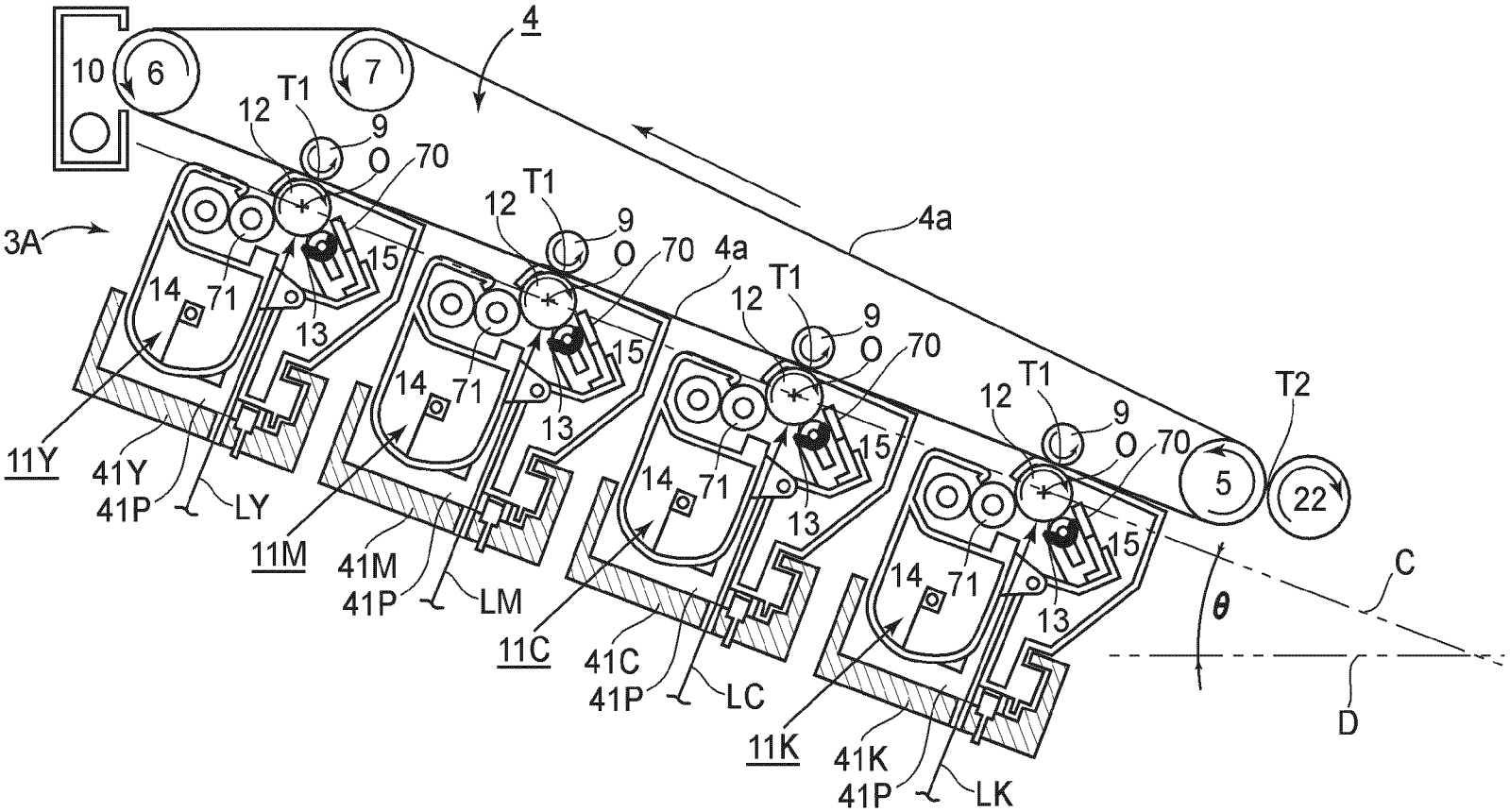
FIG. 2 is an enlarged sectional view of the portion of FIG. 1 pertinent to the present invention.
Figure 3:
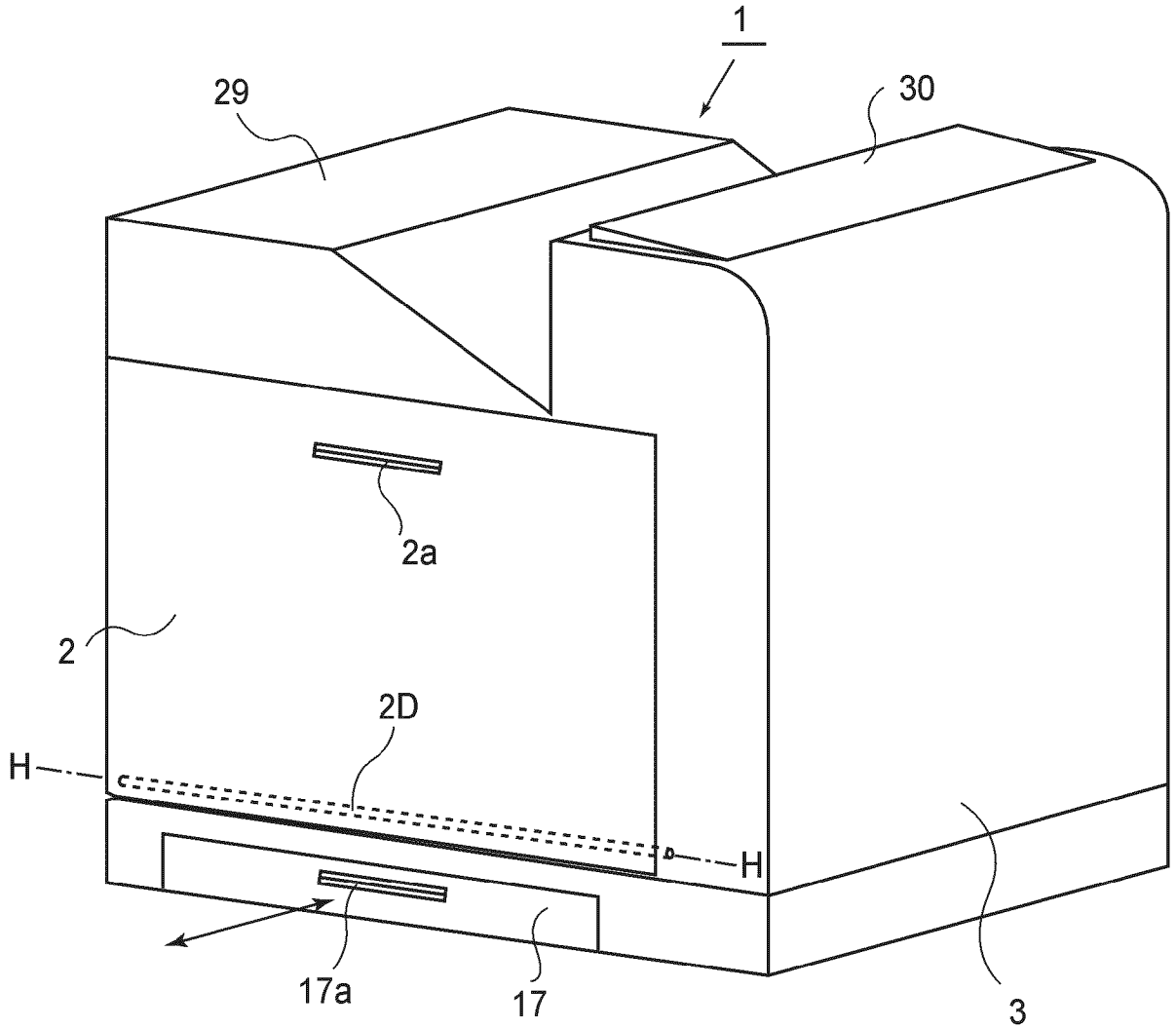
FIG. 3 is an external perspective view of the image forming apparatus in the first embodiment, the external door of which is shut.
Figure 4:
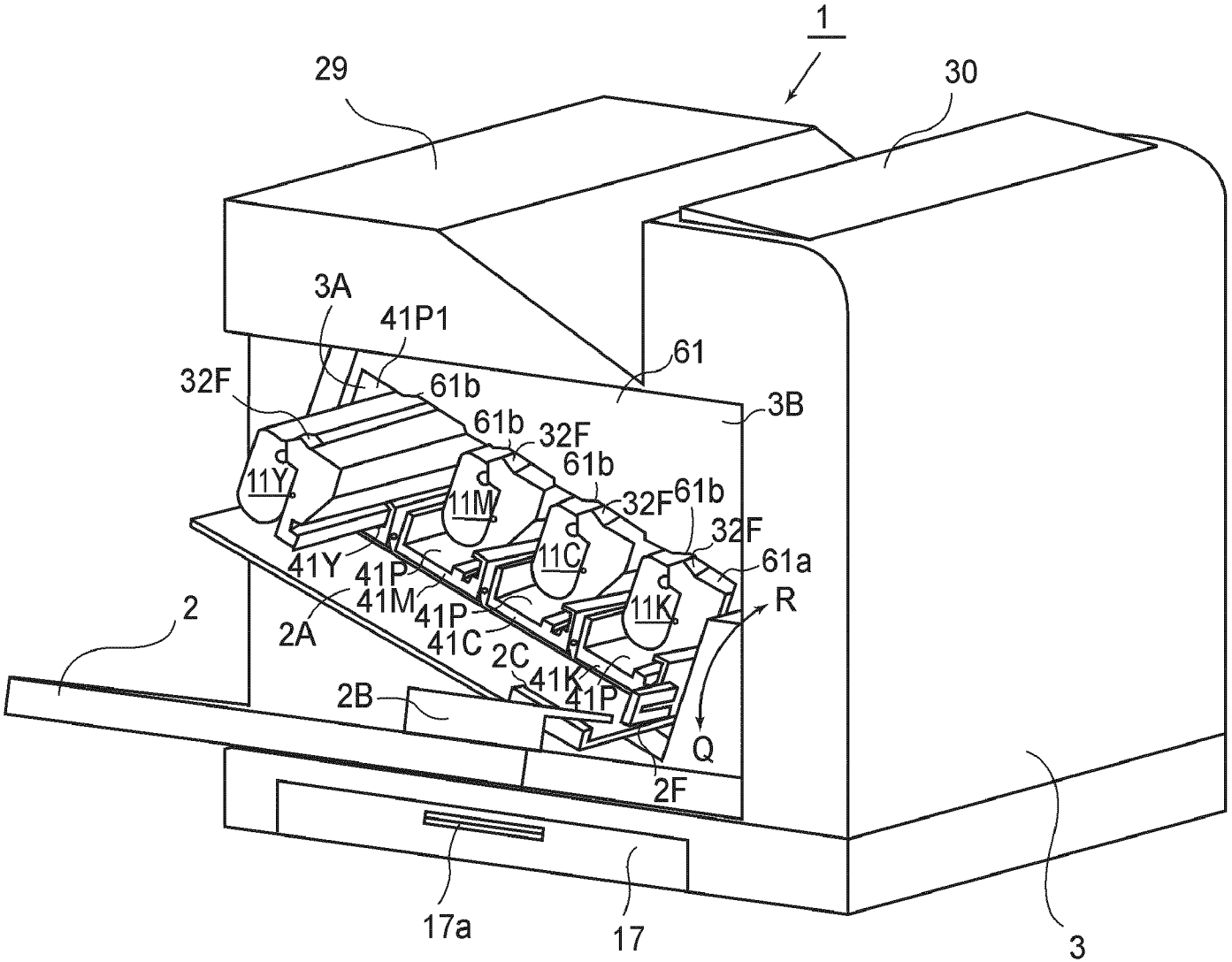
FIG. 4 is an external perspective view of the image forming apparatus in the first embodiment, when the external door of the image forming apparatus is open and one of the process cartridges is partway out of the image forming apparatus.

FIG. 1 is a schematic vertical sectional view of the image forming apparatus 1 in this embodiment, at a plane parallel to the front panel of the apparatus, when the apparatus is in operation. FIG. 2 is an enlarged schematic sectional view of the portion of the image forming apparatus 1 in this embodiment, which is pertinent to the description of the present invention. FIG. 3 is an external perspective view of the image forming apparatus 1 when the external door 2 (front door) of the apparatus 1 is open. FIG. 4 is an external perspective view of the image forming apparatus 1, the cartridge 11Y of which is partway out of the image forming apparatus 1.

In the following description of the preferred embodiments of the present invention, the front side or operator side (user side) means the side on which the external door 2 is present. In terms of the direction in which the cartridge 11 is mounted into the apparatus 1, the front side is the upstream side. In terms of the direction in which the cartridge 11 is mounted into the apparatus 1, the back side or rear side means the opposite side from the front side. The front-to-back (or back-to-front) direction means both the frontward and rearward directions. The left-to-right (or right-to-left) direction means both the leftward and rightward directions. Further, the main assembly 3 of the image forming apparatus (which hereafter may be referred to as apparatus main assembly 3) is the portion of the image forming apparatus 1, which remains after the removal of all cartridges 11 from the apparatus 1. The lengthwise direction of the structural members of the cartridge 11 and apparatus main assembly 3 is the same as the direction of the axial line of the electrophotographic photosensitive drum 12 (which hereafter will be referred to as photosensitive drum 12) which the cartridge 11 has, or the direction parallel to the axial line of the photosensitive drum 12. The widthwise direction of the cartridge 11 means the direction perpendicular to the axial line of the photosensitive drum 12. The lengthwise end of the cartridge 11, from which the force for driving the cartridge 11 is transmitted to the cartridge 11 from the apparatus main assembly 3 is referred to as the "driven side", whereas the opposite lengthwise end of the cartridge 11 from the "driven side" will be referred to as "non-driven side".

The image forming apparatus 1 in this embodiment is a full-color laser printer which employs an electrophotographic image formation process. It uses four developers (toners) different in color. It forms an image on recording medium P, such as a sheet of paper, in response to the electrical pictorial signals inputted into the control circuit portion A (controlling means: CPU) of the image forming apparatus 1 from an external host apparatus B, such as a personal computer, an image reader, etc. The control circuit portion A sends various electrical information to the control panel 30 of the image forming apparatus 1, and the external host apparatus B, or receives various electrical information from the control panel 30 of the image forming apparatus 1, and the external host apparatus B. The control circuit portion A also controls the overall operation of the image forming apparatus 1, based on preset control programs and referential tables.

This image forming apparatus 1 is designed to employ four cartridges 11, that is, first to fourth cartridges (11Y, 11M, 11C, and 11K), which are removably mountable in the main assembly 3. Incidentally, the operation for mounting the cartridges 11 into the apparatus main assembly 3 or removing the cartridges 11 from the apparatus main assembly 3 is to be carried out by an operator. More specifically, referring to FIG. 4, first, the operator is to open the external door 2 and internal door 2A of the image forming apparatus 1 to expose the front side of the interior of the apparatus 11 to allow the operator to mount the process cartridges 11 into the apparatus main assembly 3 or remove the process cartridges 11 from the apparatus main assembly 3. Each cartridge 11 is independently mountable into the apparatus main assembly 3 or removable from the apparatus main assembly 3 from the other cartridges 11. The apparatus main assembly 3 is provided with a cartridge compartment 3A (cartridge storage portion), in which the cartridges 11 are mounted. The cartridge compartment 3A is located in the middle section of the apparatus main assembly 3. The image forming apparatus 1 is structured so that when the cartridges 11 are in the cartridge compartment 3A, the lengthwise direction of the cartridges 11 is parallel to the front-to-rear direction of the apparatus main assembly 3, and also, so that the cartridges 11 are arranged in tandem, in a vertically slanted straight line which is lower on the right-hand side. Further, the image forming apparatus 1 is structured so that after the mounting of the cartridges 11 into the apparatus main assembly 3, each cartridge 11 will be in its image forming position as will be described later. As described above, when the four cartridges 11 are in the cartridge compartment 3A of the apparatus main assembly 3, they align in tandem, in the vertically slanted straight line which is lower on the right-hand side. Therefore, the first cartridge 11Y, which is positioned leftmost, is positioned highest, of the four cartridges 11, and the second cartridge 11M, which is positioned second from left, is positioned slightly lower than the first cartridge lo 11Y. The third cartridge 11C, which is positioned third from left, is positioned lower than the second cartridge 11M, and the fourth cartridge 11K, which is positioned rightmost, is positioned lowest of the four cartridges 11.

Referring to FIG. 2, designated by a referential letter C is a theoretical plane which coincides with the rotational axis O of the photosensitive drum 12 of each cartridge 11 when the cartridge is in its image forming position in the cartridge compartment 3A. Designated by a referential symbol θ is the angle of the theoretical plane C relative to a horizontal plane D. In this embodiment, this angle of the theoretical plane C is set to roughly 20°. Structuring the apparatus main assembly of an image forming apparatus so that when multiple cartridges are in their image forming position in the apparatus main assembly, they align in tandem, in the vertically slanted and straight line as are the cartridges 11 in this embodiment, can reduce the main assembly of the image forming apparatus in width in terms of the left-to-right direction of the apparatus. That is, it can reduce the apparatus main assembly of the image forming apparatus in footprint.

Each cartridge 11 has its own electrophotographic image forming system, which is virtually the same as those of the other cartridges 11. It has the photosensitive drum 12, and processing means for processing the photosensitive drum 12, that is, a charge roller 13 (charging means), a development unit 14 (developing means), and a cleaning unit 15 (cleaning means). The first cartridge 11Y stores yellow (Y) developer (which hereafter will be referred to as toner) in the toner storage portion of its development unit 14. The cartridge 11Y develops an electrostatic latent image with toner of yellow color. The second cartridge 11M stores magenta (M) developer in the toner storage portion of its development unit 14. The cartridge 11M develops an electrostatic latent image with toner of magenta color. The third cartridge 11C stores cyan (C) developer in the toner storage portion of its development unit 14. The cartridge 11C develops an electrostatic latent image with toner of cyan color. The fourth cartridge 11K stores black (K) developer in the toner storage portion of its development unit 14. The cartridge 11K develops an electrostatic latent image with toner of black color. When the cartridge 11 is in its image forming position in the cartridge compartment 3A, the force for rotationally driving the cartridge 11 is transmitted to the cartridge 11 from the apparatus main assembly 3. As the driving force is transmitted to the cartridge 11, the photosensitive drum 12 rotates in the clockwise direction indicated by an arrow mark at a preset peripheral velocity, and a development roller 71 rotates in the direction indicated by another arrow mark (FIG. 6) at a preset peripheral velocity. Further, to the cartridge 11, preset biases (charge bias, development bias, etc.) are supplied from the apparatus main assembly 3.

The four cartridges 11 are different in the color of the toner they store, but are the same in structure.

The apparatus main assembly 3 is provided with a laser scanner 16, as an exposing means, which is in the bottom portion of the apparatus main assembly 3A. The laser scanner 16 projects a beam of laser light upon the peripheral surface of the photosensitive drum 12 while modulating the beam of laser light with the information regarding the image to be formed.

The apparatus main assembly 3 is also provided with an intermediary transfer belt unit 4 (transferring means, or transfer medium conveying means, which is in the form of belt), which is above the cartridge compartment 3A. The unit 4 is made up of a secondary transfer roller 5, a follower roller 6, a tension roller 7, and an intermediary transfer belt 4*a* (which hereafter will be referred to simply as belt 4*a*). The secondary transfer roller 5 is positioned in the loop which the belt 4*a* forms, and is at the left end of the loop. The follower roller 6 is also positioned in the loop which the belt 4*a* forms, but, is at the right end of the loop. The tension roller 7 is also in the belt loop. It is positioned closer to the follower roller 6 than the secondary transfer roller 5. The belt 4*a* is stretched around these rollers 5, 6, and 7, being supported by the rollers. The belt 4*a* is a flexible endless belt. The three rollers 5, 6, and 7 are arranged in parallel, with their rotational axes parallel to the front-to-rear direction. The tension roller 7 is kept under the upward pressure, providing the belt 4*a* with tension. Further, the rollers 5 and 6 are positioned so that the portion of the belt 4*a*, which is moving through the bottom portion of the belt loop, has the same angle, relative to the abovementioned theoretical horizontal plane C, as the angle θ at which the four cartridges 11 align in tandem, in the abovementioned slanted straight line, which is lower on the right-hand side. When any of the cartridges 11 is in its image forming position in the cartridge compartment 3A, the top portion of the peripheral surface of its photosensitive drum 12 is in contact with the downwardly facing portion of the portion of the belt 4*a*, which is between rollers 5 and 6. This area of contact between the photosensitive drum 12 and belt 4*b* constitutes a primary transfer station T1. The apparatus main assembly 3 is provided with four (first to fourth) primary transfer rollers 9 (primary transferring means), which oppose the four photosensitive drums 12, with the belt 4*a* sandwiched between the primary transfer rollers 9 and photosensitive drums 12, one for one. The primary transfer rollers 9 are arranged in parallel, with their axial lines parallel to the front-to-rear direction of the apparatus main assembly 3. The belt 4*a* is driven by the secondary transfer roller 5, which also functions as a driver roller, being circularly moved in the counterclockwise direction indicated by an arrow mark, at the velocity which matches the peripheral velocity of the photosensitive drum 12, while remaining in contact with the top portion of the peripheral surface of each photosensitive drum 12 by the portion which is moving through the bottom portion of its loop. To each of the rollers 9, a preset primary transfer bias is applied with preset control timing. Further, the apparatus main assembly 3 is provided with an outer secondary transfer roller 22, which is in contact with the outer surface of the belt 4*a* (with reference to belt loop), at the curved portion of the belt loop, which corresponds to the roller 5. The area of contact between the belt 4*a* and roller 22 constitutes a second transfer station T2. To the roller 22, a preset secondary transfer bias is applied with preset control timing. Further, the apparatus main assembly 3 is provided with a belt cleaning unit 10, which is in contact with the outer surface of the belt 4*a* (with reference to belt loop), at the curved portion of the belt loop, which corresponds to the roller 6. The belt 4*a* is cleaned by the unit 10.

The apparatus main assembly 3 is provided with a recording medium cassette compartment and a recording medium conveying means. The recording medium cassette compartment is in the bottom portion of the apparatus main assembly 3, and in which a recording medium cassette 7 is mounted. The recording medium conveying means is in the right-hand portion of the apparatus main assembly 3, and extends upward of the apparatus main assembly 3 from the recording medium cassette compartment. The recording medium conveying means has a pickup roller 18, a separation pad 19, and a recording medium conveyance passage 20. The pickup roller 18 and separation pad 19 are located so that they will be at the recording medium releasing end of the cassette 17 when the cassette 17 is in the proper position in the apparatus main assembly 3. The recording medium conveyance passage 20 extends upward from the interface between the pickup roller 18 and separation roller 19. The apparatus main assembly 3 is also provided with a pair of registration rollers 21, the secondary transfer station T2, a recording medium conveyance guide 23, a fixation unit 24, and a recording medium discharge unit 31. A part of the top surface of the apparatus main assembly 3 constitutes a delivery tray 29. The unit 31 has a pair of first discharge rollers 25, a recording medium conveyance passage 26, a pair of second discharge rollers 27, and a recording medium discharge hole 28. The cassette 17 is to be mounted into, or removed from, the apparatus main assembly 3, from the front side of the apparatus main assembly 3. Designated by a referential symbol 17*a* is a handhold with which the cassette 17 is provided.

The full-color image forming operation of this image forming apparatus 1 is as follows: The control circuit A starts the image forming operation of the image forming apparatus 1 in response to a print start signal. That is, in synchronism with the image formation timing, the drum 12 and development roller 71 of each of the first to fourth cartridges 11 (11Y, 11M, 11C, and 11K) rotate in the direction indicated by the arrow mark (FIG. 6) at virtually the same peripheral velocity, and the belt 4*a* rotates in the counterclockwise direction indicated by the arrow mark (FIG. 2) so that it moves in the same direction as the peripheral surface of the drum 12, in the area of contact between the belt 4*a* and drum 12. The control circuit A also drives the laser scanner unit 16. As the laser scanner unit 16 is driven, the peripheral surface of the drum 12 in each drum 12 is uniformly charged to preset polarity and potential level by the charge roller 13, to which a preset charge bias is being applied. More specifically, the scanner unit 16 exposes the peripheral surface of each drum 12 with a beam of laser light L (LY, LM, LC, or LK), which it outputs while modulating the beam of laser light L with pictorial information signals which correspond to Y, M, C, or K color, respectively. As the beam of laser light L is outputted from the scanner unit 16, it enters the corresponding cartridge 11 through the laser beam entrance hole, which is on the bottom side of the cartridge 11, and illuminates the bottom portion of the peripheral surface of the drum 12. As a result, an electrostatic latent image, which reflects the pictorial information signals, is formed on the peripheral surface of the drum 12 in each cartridge 11. The latent image is developed into a visible image, that is, an image formed of toner (which hereafter will be referred to as toner image), by the development roller 71 with which the development unit 14 is provided.

Through the above described electrophotographic image formation process, a yellow toner image, which corresponds to the yellow color components of an intended full-color image is formed on the drum 12 which the first cartridge 11Y has. The yellow toner image is transferred (primary transfer) onto the belt 4*a* in the primary transfer station T1 of the cartridge 11Y. Similarly, a magenta toner image, which corresponds to the magenta color components of the intended full-color image is formed on the drum 12 which the second cartridge 11M has. The magenta toner image is transferred (primary transfer) onto the belt 4*a* in the primary transfer station T1 of the cartridge 11M, in a manner to be aligned with the yellow toner image on the belt 4*a*. Further, a cyan toner image, which corresponds to the cyan color components of the intended full-color image is formed on the drum 12 which the third cartridge 11C has. The cyan toner image is transferred (primary transfer) onto the belt 4*a*, in the primary transfer station T1 of the cartridge 11C, in a manner to be aligned with the yellow and magenta toner images on the belt 4*a*. Lastly, a black toner image, which corresponds to the block color components of the intended full-color image is formed on the drum 12 which the black cartridge 11K has. The black toner image is transferred (primary transfer) onto the belt 4*a*, in the primary transfer station T1 of the cartridge 11K, in a manner to be aligned with the yellow, magenta, and cyan toner images on the belt 4*a*. To the first to fourth primary transfer rollers 9, a primary transfer bias is applied, which is preset in potential level and is opposite in polarity from the polarity to which the toners have been charged.

As a result, the unfixed Y, M, C, and K toner images, which make up a single full-color image, are placed in layers on the belt 4*a*, which is being moved. The unfixed toner images are conveyed to the second transfer station T2 by the further rotation of the belt 4*a*.

In each cartridge 11, the transfer residual toner, that is, the toner remaining on the portion of the peripheral surface of the drum 12, from which a toner image is transferred (primary transfer) onto the belt 4*a*, is removed by a cleaning member 70 which the cleaning unit 15 has; the peripheral surface of the drum 12 is cleaned by the cleaning member 70. Then, the drum 12 is prepared for the next phase of the image formation process.

Meanwhile, the recording mediums P in the cassette 17 are moved out of the cassette 17, while being separated one by one, into the recording medium conveyance passage 20, by the combination of the pickup roller 18 and separation pad 19. Each recording medium P is conveyed by the pair of registration rollers 21 to the secondary transfer station T2 with preset control timing. To the roller 22, the secondary transfer bias, which is preset in potential level, is applied with preset control timing. The polarity of the second transfer bias is the opposite from the polarity to which the toners have been charged. Thus, while the recording medium P is conveyed through the secondary transfer station T2 while remaining sandwiched by the drum 12 and belt 4*a*, the four toner images, which are different in color and are layered on the belt 4*a*, are transferred together (secondary transfer) onto the surface of the recording medium P in a manner of being peeled away from the drum 12, from the downstream end in terms of the rotational direction of the drum 12. After being conveyed out of the secondary transfer station T2, the recording medium P is conveyed to the fixation unit 24 while being guided by the recording medium conveyance guide 23. In the fixation unit 24, the recording medium P and the unfixed toner images thereon are subjected to heat and pressure by the heat roller 24*a* and pressure roller 24*b* of the fixation unit 24, becoming fixed to the surface of the recording medium P. After being conveyed out of the fixation unit 24, the recording medium P is conveyed further by the pair of first discharge rollers 25 through the recording medium conveyance passage 26, and is discharged by the pair of second discharge rollers 27 onto the delivery tray 29, which is a part of the top surface of the apparatus main assembly 3.

After the transfer (secondary transfer) of the toner images onto the recording medium P, the surface of the belt 4*a* is cleaned by the belt cleaning unit 10, being prepared for the next step in the image forming process; the transfer residual toner, that is, the toner remaining on the surface of the belt 4*a* after the secondary transfer, is removed by the belt cleaning unit 10.

<Process Cartridge>

Figure 5:
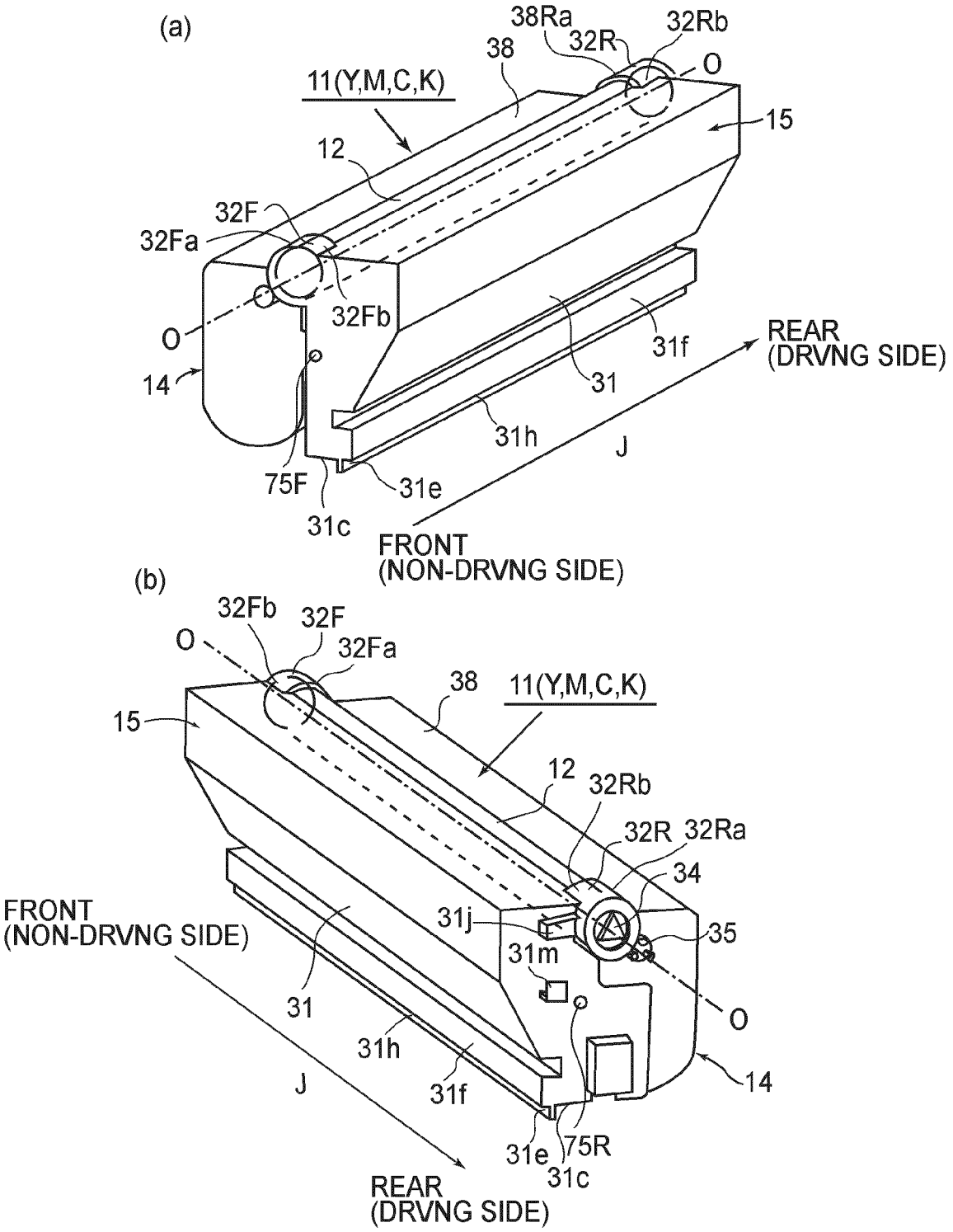
FIG. 5(*a*) is an external perspective view of the process cartridge, as seen from the side from which the cartridge is not driven, and FIG. 5(*b*) is an external perspective view of the process cartridge, as seen from the side from which the cartridge is driven.
Figure 6:
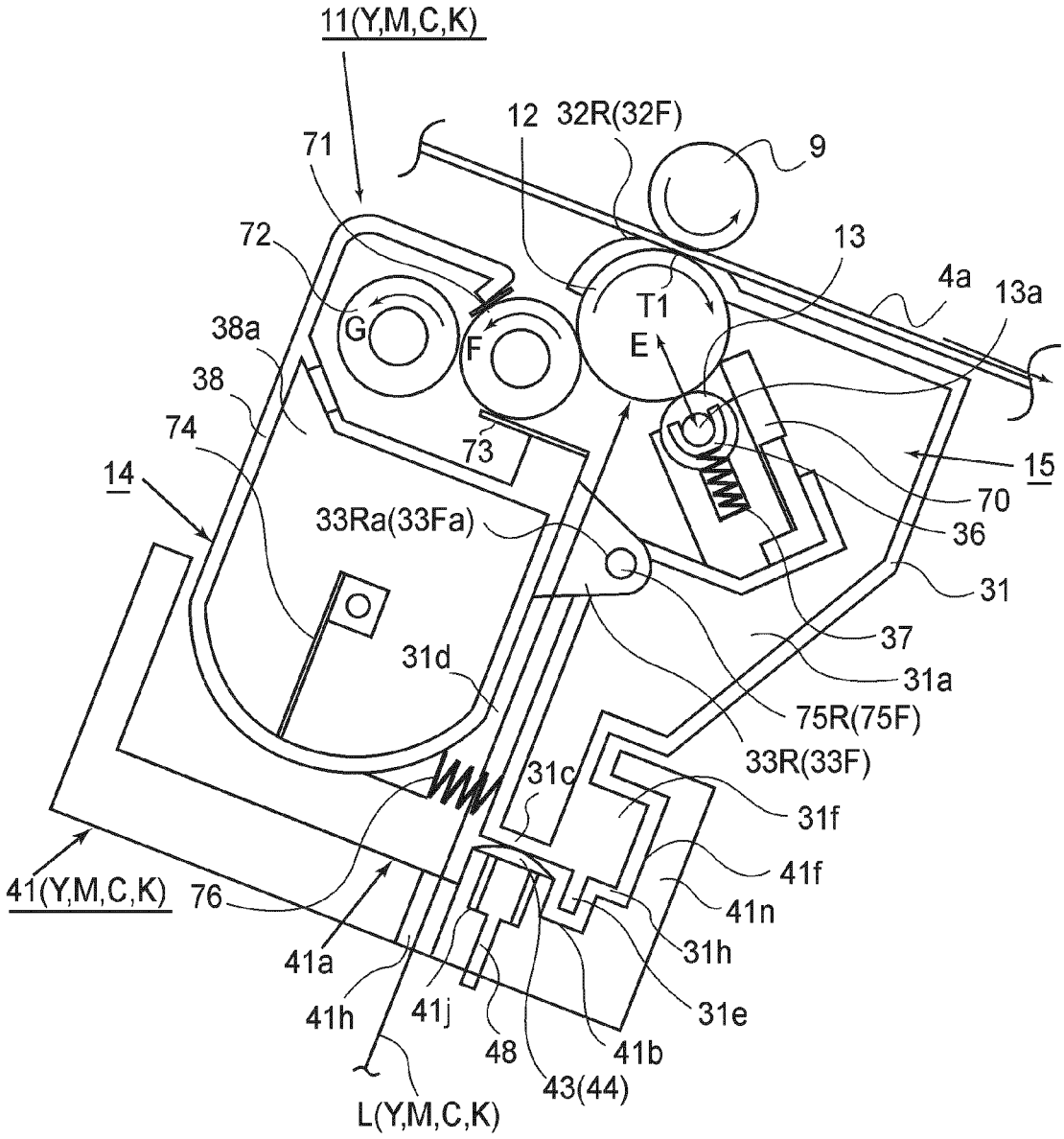
FIG. 6 is an enlarged schematic sectional view of one of the cartridges in its image forming position in the main assembly of the image forming apparatus, and the adjacencies of the cartridge.

Next, referring to FIGS. 5 and 6, the cartridge 11 in this embodiment will be described. The first to fourth cartridges (11Y, 11M, 11C, and 11K) are the same in structure although they are different in the color of the toner they store in the toner storage portion of their development unit 14; they store yellow (Y), magenta (M), cyan (C), and black (K) toners, respectively. FIG. 5(*a*) is an external perspective view of the cartridge 11, as seen from the front side in terms of the cartridge mounting direction (as seen from non-driven side). FIG. 5 (*b*) is an external perspective view of the cartridge 11, as seen from the rear side (as seen from driven side) in terms of the cartridge amounting direction. FIG. 6 is an enlarged sectional view of the cartridge 11 when it is in its image forming position in the apparatus main assembly 3, and the adjacencies of the cartridge 11.

Referring to FIG. 5, the cartridge 11 is structured so that the rotational axis O-O of the drum 12 is parallel to the lengthwise direction of the cartridge 11. As seen from the direction from which the cartridge is mounted into the apparatus main assembly 3, the rear end of the cleaning unit frame 31 is provided with a drum coupling 34 (drum rotating force receiving portion), and a development roller coupling 35. The coupling 34 is the portion of the cartridge 11, through which the cartridge 11 receives the rotational driving force for rotating the drum 12 from the coupling 3*b* (FIGS. 7(*a*), 7(*b*), 7(*c*), 8, 9, and 11), with which the apparatus main assembly 3 is provided. The coupling 35 is the portion of the cartridge 11, through which the cartridge 11 receives the rotational driving force for rotating the development roller 71 (FIG. 6) from the coupling 3*c* (FIGS. 8, 9, and 11) with which the apparatus main assembly 3 is provided. Incidentally, the coupling 3*b*, through which the drum driving force is outputted, is moved in the lengthwise direction (which is indicated by arrow mark T in FIGS. 7(*a*), 7(*b*), and 7(*c*)) of the drum 12 by the opening or closing movement of the external door 2. The coupling 3*c*, through which the development roller driving force is outputted, is movable in the direction perpendicular to the lengthwise direction of the drum 12. Therefore, closing of the external door 2 causes the coupling 3*b* to engage with the coupling 34, whereas opening of the external door 2 causes the coupling 3*b* to disengage from the coupling 34. Further, the upward movement of the cartridge 11 causes the coupling 3*c* to engage with the coupling 35 (because coupling 3*c* is movable in direction perpendicular to lengthwise direction of drum 12), whereas the downward movement of the cartridge 11 causes the coupling 3*c* to disengage from the coupling 35.

Referring to FIG. 6, the cartridge 11 is made up of the cleaning unit 15 (drum unit) having the drum 12, charge roller 13, and cleaning member 70, and development unit 14 having the development roller 71. The units 14 and 15 are connected to each other in such a manner that they are rotationally movable relative to each other.

To the cleaning unit frame 31, that is, the frame of the unit 15, the drum 12 is rotatably attached, with a bearing members 32F placed between the front end portion of the drum 12 and the cleaning unit frame 31, and a bearing member 32R placed between the rear end portion of the drum 12 and the cleaning unit frame 31. As described above, the charge roller 13 and cleaning member 70 are disposed in the adjacencies of the peripheral surface of the drum 12. To the drum 12, the drum rotating force is transmitted through the abovementioned coupling 3*b*, that is, the drum driving force transmitting coupling, rotating the drum 12 during an image forming operation. The transfer residual toner removed from the peripheral surface of the drum 12 by the cleaning member 70 falls into a waste toner storage chamber 31*a*. A bearing 36 is attached to the cleaning unit frame 31 in such a manner that it is allowed to move in the direction indicated by an arrow mark E. The axle 13*a* of the charge roller 13 is rotatably borne by the bearing 36, which is kept pressed toward the drum 12. Therefore, the charge roller 13 is kept pressed upon the drum 12 with the presence of a preset amount of contact pressure between the charge roller 13 and drum 12. The charge roller 13 is rotated by the rotation of the drum 12.

The development unit 14, which constitutes the developing apparatus, has the development roller 71 and a development unit frame 38. The development roller 71 rotates in contact with the drum 12, in the direction indicated by an arrow mark F. The development roller 71 is rotatably supported by a pair of bearing members (unshown) attached to the front and rear ends of the development unit frame 38, one for one. The development unit 14 is also provided with a toner supply roller 72 and a development blade 73, which are disposed in the adjacencies of the peripheral surface of the development roller 71. The toner supply roller 72 is rotated in contact with the development roller 71 in the direction indicated by an arrow mark G. The development blade 73 is for regulating the toner layer on the development roller 71. The development unit 14 is also provided with a toner stirring member 74, which is located in the toner storage portion 38*a* (developer container) of the development unit frame 38 to convey the toner in the toner storage portion 38*a* to the toner supply roller 72 while stirring the toner. As the rotational driving force is transmitted to the coupling 35 through the coupling 3*c*, that is, the coupling through which the force for rotationally driving the development roller 71 is transmitted to the development roller 71, the development roller 71, toner supply roller 72, and toner stirring member 74 rotate.

The development unit 14 is connected to the cleaning unit 15 in a manner to allow the two units to rotationally move relative to each other about a pair of pins 75F and 75R. More concretely, the development unit frame 38 is provided with a connective front arm 33F having a hole 33Fa, and a connective rear arm 33R having a hole 33Ra, and the pair of pins 75F and 75R are put through the holes 33Fa and 33Ra, respectively. During an image forming operation, the development unit 14 of the cartridge 11 is kept pressed by the resiliency of a pair compression springs 76 placed between the development unit 14 and cleaning unit 15, in the direction to cause the development unit 14 to rotate about the pins 75F and 75R. Thus, the development roller 71 is kept pressed on the drum 12, with the presence of a preset amount of contact pressure between the development roller 71 and drum 12 during an image forming operation.

The bottom portion of 31*h* of the cleaning unit frame 31 is provided with a contact area 31*c* (by which cleaning unit 31 receives pressure applied thereto) and a rib 31*f* (long and narrow projection, which controls vertical movement of cartridge 11), which extend in the lengthwise direction of the cartridge 11. Further, the bottom portion 31*h* is provided with a rib 31*e* (which hereafter will be referred to as guiding rib), which is roughly in the middle of the bottom surface of the bottom portion 31*h* of the cleaning unit frame 31 and extends in the lengthwise direction of the cartridge 11. The development unit 14 and cleaning unit 15 are connected to each other in a manner to leave a slit 31*d* (laser beam entrance into cartridge 11). That is, the slit 31*d* is a gap between the units 15 and 14.

<Method for Replacing Process Cartridge in Apparatus Main Assembly>

As each of the cartridges 11 in the apparatus main assembly 3 is used for image formation, the toner stored in its development unit 14 is consumed. Thus, each cartridge 11 is provided with a detecting means (unshown) for detecting the amount of toner remainder in the cartridge 11. The amount of toner remainder in the cartridge 11 detected by the toner remainder amount detecting means is compared by the control circuit A with a threshold value preset to inform an operator (user) of the remaining amount of the service life of the cartridge 11, or to issue a warning that the cartridge 11 will soon run out of toner. Thus, as the control circuit A detects that the amount of toner in the toner storage portion of any cartridge 11 in the apparatus main assembly 3 has reduced to a value smaller than the above mentioned threshold value, it causes the display portion (unshown) of the apparatus main assembly 3 to display the estimated length of the remaining service life of the cartridge, or a warning message, prompting the operator (user) to prepare a replacement cartridge in order to maintain the image forming apparatus at a satisfactory level in image quality.

The cartridges 11 in the image forming apparatus 1 in this embodiment are to be replaced by an operator (user). In order to replace the cartridges 11 in the apparatus main assembly 3, the external door 2 and internal door 2A of the apparatus main assembly 3 must be opened by the operator as shown in FIG. 4. In other words, this image forming apparatus 1 is of a so-called front access type. Designated by a referential number 2*a* is a handhold portion with which the external door 2 is provided. The external door 2 and internal door 2A are connected by connective members 2B and 2C. The internal door 2A is opened or closed by the opening or closing movement of the external door 2, respectively.

The external door 2 exposes or covers an opening 3B through which the cartridges 11 are put when the cartridges 11 are mounted into, or removed from, the apparatus main assembly 3. That is, the external door 2 is a door that makes the opening 3B accessible or inaccessible.

The cartridge compartment 3A (interior of apparatus main assembly 3) is provided with first to fourth cartridge supporting members 41 (41Y, 41M, 41C, and 41K) which support the first to fourth cartridges 11 (11Y, 11M, 11C, and 11K), respectively. The space which each cartridge 11 occupies when it is supported by the corresponding cartridge supporting member 41 is one of the four cartridge slots 41P of the cartridge compartment 3A. The internal door 2A is attached to the cartridge supporting members 41. It is opened or closed by the opening or closing movement of the external door 2, exposing or covering the cartridge slots 41P. That is, the internal door 2A is a door that makes the opening 41*p*1 (FIG. 4) of each cartridge slot 41P accessible or inaccessible.

The front frame 61 of the apparatus main assembly 3 is provided with an opening 61*a*, through which the cartridges 11 are inserted into, or moved out of, the apparatus main assembly 3. That is, the opening 61*a* is provided to allow the cartridges 11 to be mounted into, or removed from, the apparatus main assembly 3. The direction in which each cartridge 11 is mounted into, removed from, the apparatus main assembly 3 is parallel to the axial line of each drum 12.

The external door 2 and internal door 2A are attached to the apparatus main assembly 3 in such a manner that the external door 2 and internal door 2A are movable between their shut position, in which they cover the opening 61*a*, and their open position, in which they expose the opening 61*a*. In this embodiment, the external door 2 is rotationally movable about a connective rod 2D (first rotational axle), with which the external door 2 is attached to the apparatus main assembly 3 by its bottom edge, to be rotationally moved away from, or rotationally moved upon, the apparatus main assembly 3. Further, the external door 2 can be locked in its open position (rotationally away from apparatus main assembly 3) or closed position (flat on apparatus main assembly 3). The connective rod 2D is rotatably supported by the bearing members with which the front frame 61 is provided. In this embodiment, in consideration of the ease with which the external door 2 can be opened or closed by an operator, the connective rod 2D is attached to the front frame 61 so that the axial line H-H of the connective rod 2D is horizontal, and parallel to the front panel of the apparatus main assembly 3. The external door 2 can be rotated frontward or rearward by 90° about the connective rod 2D, and can be locked in a position in which it is shut against the apparatus main assembly 3 and is roughly vertical, and also, a position in which it is roughly horizontal. In terms of the rotational direction of the external door 2, the distance between the shut position and open position is roughly 90°.

Figure 11:
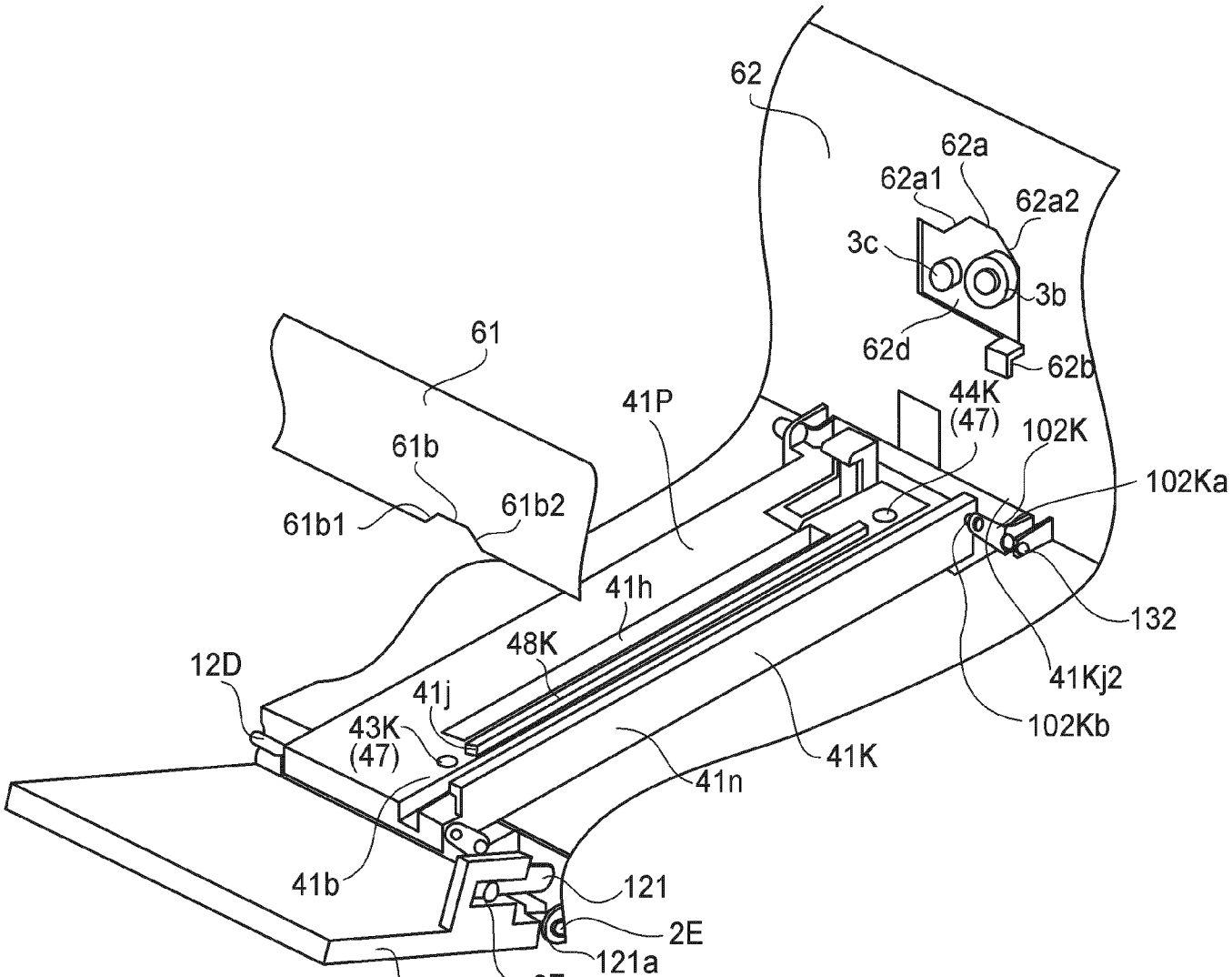
FIG. 11 is a perspective view of the joint between the internal door and elevator lever, showing the structure of the joint.

The internal door 2A is on the inward side of the external door 2. It is attached to the apparatus main assembly 3 with the use of an inner door connective rod 2E (second rotational axle: FIG. 11). The internal door 2A is rotatable about the connective rod 2E, being enabled to take an open position or shut position relative to the cartridge compartment 3A. The connective rod 2E is rotatably supported by the bearing member with which the front frame 61 of the apparatus main assembly 3 is provided. The connective rod 2E is attached to the front frame 61 so that its angle relative to the horizontal direction is roughly the same as the angle θ of the abovementioned theoretical plane C relative to the horizontal direction. That is, the connective rod 2E is slanted relative to the horizontal direction, with its right-hand end positioned lower than its left-hand end. The connective rod 2D, about which the external door 2 is rotated, and the connective rod 2E about which the internal door 2A is rotated, are not parallel to each other; they are angled relative to each other. More specifically, the connective rod 2E is perpendicular to the direction in which the cartridge 11 is mounted or removed, and is different in the angle relative to the horizontal direction from the connective rod 2D. Even thought the connective rods 2D and 2D are different in the angle relative to the horizontal direction, the connective members 2B and 2C which connect the external and internal doors 2 and 2A are capable of causing the opening or closing movement of the external door 2 to open or close the internal door 2A.

The lengthwise direction of each supporting member 41 is parallel to the front-to-rear direction of the apparatus main assembly 3. Each supporting member 41 is tilted so that its widthwise direction is roughly parallel to the abovementioned theoretical plane C; the angle of the shorter edges of the supporting member 41 relative to the horizontal direction is roughly the same as the angle θ of the abovementioned theoretical plane C relative to the horizontal direction. That is, the supporting member 41 is tilted so that its right-hand end in terms of its widthwise direction is positioned lower than its left-hand end. Thus, the first supporting member 41Y, which is the leftmost supporting member in the apparatus main assembly 3, is positioned highest, and the second supporting member 41M is positioned slightly lower than the first supporting member 41Y. The third supporting member 41C is positioned lower than the second supporting member 41M, and the fourth supporting member 41K, that is, the rightmost supporting member, is positioned lowest. That is, the first to fourth supporting members 41 are arranged in tandem, in such a slanted and straight line that the second to fourth supporting members 41 are positioned slightly lower than the supporting member 41 on their left.

Each supporting member 41 is movable between the first and second position by a supporting member elevator 50 which is moved by the opening or closing movement of the internal door 2A which is moved by the opening or closing movement of the external door 2. That is, each supporting member 41 is movable between first and second positions. The first position is the position in which the supporting member 41 keeps the cartridge 11 in the image forming position in the apparatus main assembly 3, and the second position allows the cartridge 11 to be removably mounted on the supporting member 41. The first position corresponds to when the external and internal doors 2 and 2A are in their completely closed positions, and the drum 12 is in contact with the belt 4*a*. The second position corresponds to when the external and internal doors 2 and 2A are in their fully open position, and a gap is present between the drum 12 and belt 4*a*.

As described above, each supporting member 41 is enabled to take the first position which corresponds to when the external and internal doors 2 and 2A are in their completely closed positions and the drum 12 is in contact with the belt 4*a*, and the second position which corresponds to when the external door 2 and internal door 2A are in their fully open position and a gap is present between the drum 12 and belt 4*a*. That is, the first position corresponds to when the cartridge 11 is entirely in its cartridge slot in the cartridge compartment 3A, and the drum 12 is in contact with the belt 4*a*. The second position corresponds to where the cartridge 11 can be mounted onto, or removed from, the supporting member 41.

The moving direction of the each supporting member 41 is perpendicular to the direction in which the cartridges 11 are arranged in tandem. Thus, each supporting member 41 moves the corresponding cartridge 11 upward or downward in the direction parallel to the moving direction of the supporting member 41.

Figure 7:
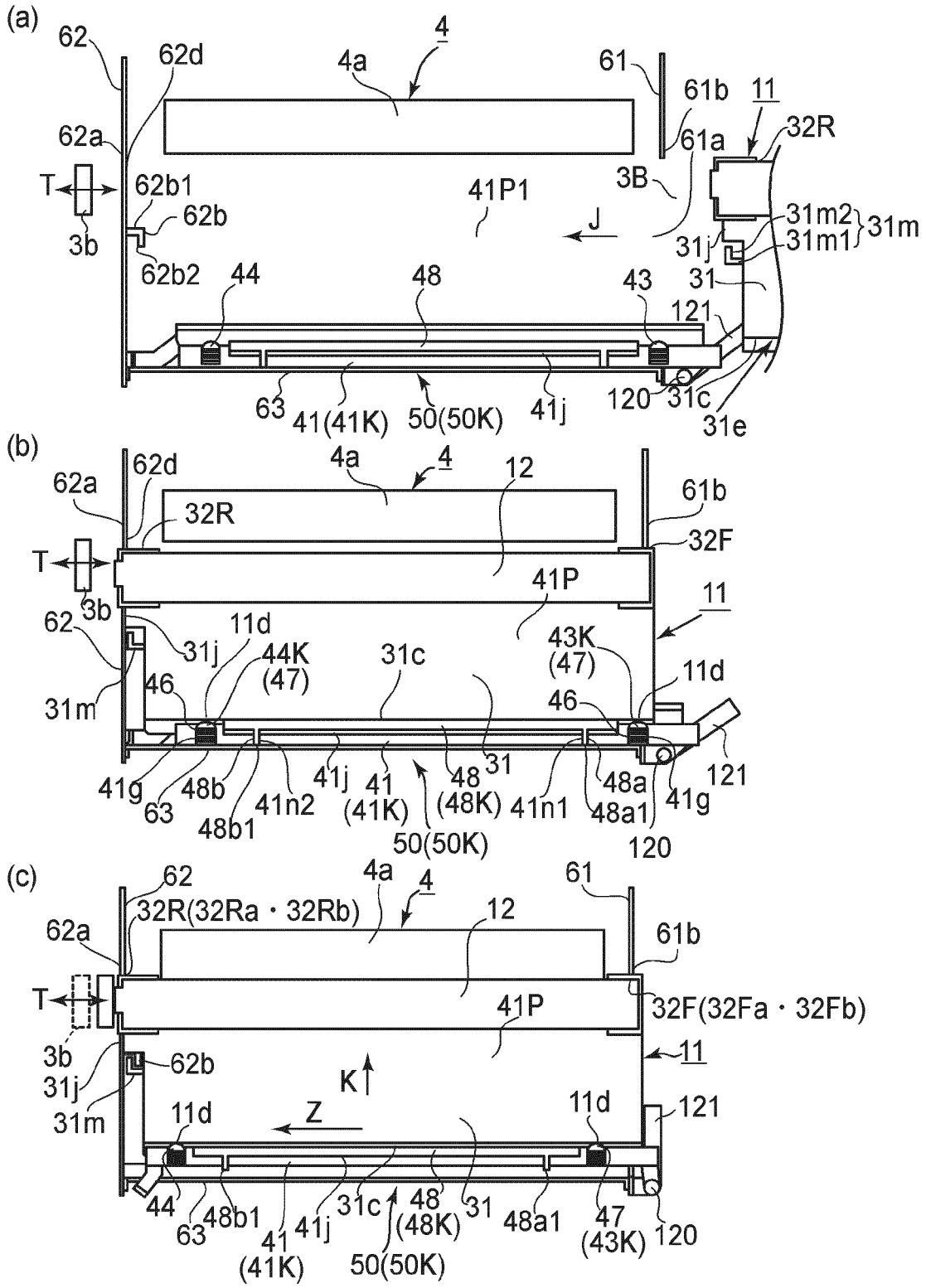
FIG. 7 is a drawing for showing the operation for mounting the cartridge into the main assembly of the image forming apparatus.

Next, the supporting member 41 and supporting member elevator 50 (which hereafter will be referred to simply as elevator 50) will be described in detail regarding their structure. FIGS. 7(*a*)-7(*c*) are drawings for describing the movements of the cartridge 11, which occur when the cartridge 11 is mounted into the apparatus main assembly 3. They are the drawings of the cartridge 11 as seen from the left side of the apparatus main assembly 3.

FIG. 7(*a*) is a drawing of the cartridge 11 when the cartridge 11 is ready to be mounted into the apparatus main assembly 3. The external door 2 and internal door 2A are fully open, fully exposing the opening 61*a*. The supporting member 41 has been moved into the second position, that is, the position in which the supporting member 41 allows the cartridge 11 to be removably mounted onto the supporting member 41. The cartridge 11 is mounted onto the supporting member 41 in the direction indicated by an arrow mark J through the opening 61*a*, in such a manner that the abovementioned contact area 31*c* with which the cleaning unit frame 31 is provided is supported and remains supported by a cartridge supporting rail 48, which projects from the supporting member 41 of the apparatus main assembly 3, and a pair of pressure applying members 43 and 44.

FIG. 7(*b*) is a drawing of the cartridge 11 when the cartridge 11 is in its rearmost position in the apparatus main assembly 3. As the cartridge 11 is mounted in the direction indicated by the arrow mark J, the contact area 31*j*, which is a part of the rearmost end of the cleaning unit frame 31, that is, a part of the leading end of the cleaning unit frame 31 in terms of the direction in which the cartridge is mounted into the apparatus main assembly 3, comes into contact with the inward surface of a cartridge position regulating portion 62 (rear wall of cleaning unit frame 31). That is, the cartridge 11 is stopped in its deepest position in the apparatus main assembly 3. In other words, the cartridge 11 is properly positioned relative to the apparatus main assembly 3 in terms of its lengthwise direction. However, when the cartridge 11 is in this position, the cartridge 11 has not been completely positioned relative to the apparatus main assembly 3. Further, the drum 12 is not in contact with the belt 4*a*. Incidentally, the contact area 31*j* is an integral part of the downstream wall of the drum unit frame 31 in terms of the cartridge mounting direction.

FIG. 7(*c*) is a drawing of the cartridge 11 in the apparatus main assembly 3 after the external door 2 and internal door 2A, which were in the state shown in FIG. 7(*b*), were completely closed. That is, FIG. 7(*c*) shows the cartridge 11 which is in its image forming position (first position) in the apparatus main assembly 3, into which it has been moved by the movement of the supporting member 41, which was caused by the closing movement of the external door 2 and internal door 2A. In other words, FIG. 7(*c*) is a drawing of the cartridge 11 after the completion of the operation for mounting the cartridge 11 into the apparatus main assembly 3. Referring to FIG. 7(*b*), as the external door 2 and internal door 2A are closed after the completion of the mounting of the cartridge 11 onto the supporting member 41, the supporting members 41 are raised by the elevator 50, and the rail 48 retracts into the supporting member 41. Thereafter, the pressure applying members 43 and 44 of the supporting member 41 press the contact area 31*c* in the direction indicated by an arrow mark K. Therefore, a pair of drum bearing members 32F and 32R, which also function as cartridge positioning members and are located on the front and rear ends of the cartridge 11, are placed in contact with the contact areas 61*b* and 62*a*, which are the cartridge position regulating portions of the front and rear frames 61 and 62 of the apparatus main assembly 3, respectively. That is, the bearing member 32F is placed in contact with the frame 61, and the bearing member 32R is placed in contact with the frame 62. As a result, the cartridge 11 is precisely positioned relative to the apparatus main assembly 3. When the cartridge 11 is in this precise position relative to the apparatus main assembly 3, the drum 12 is in contact with the belt 4*a* across its entire length.

As described above, in this embodiment, the supporting member 41 is moved upward by the closing movement of the external door 2 and internal door 2A. Thus, as the external door 2 and internal door 2A are closed, the cartridge 11 supported by the supporting member 41 moves upward, causing the drum 12 in the cartridge 11 to come into contact with the belt 4*a*, across the entire length of the drum 12.

In this embodiment, the cartridges 11 can be individually supported by their own supporting member 41. That is, each cartridge 11 is individually supported in its own slot on the supporting member 41, or individually moved away from the supporting member 41. Further, all the cartridges 11 supported by the supporting members 41 one for one can be moved into the cartridge compartment 3A roughly at the same time by the closing movement of the external door 2 and internal door 2A so that the drums 12 which the cartridges 11 have one for one can be placed in contact with the belt 4*a*, across their entire range in terms of the lengthwise direction of the drum 12.

As described above, in this embodiment, the image forming apparatus 1 is structured so that all cartridges 11 can be mounted into the cartridge compartment 3A by the closing movement of the doors 2 and 2A, being therefore superior to an image forming apparatus in accordance with the prior art (which hereafter will be referred to simply as conventional image forming apparatus), in terms of the efficiency with which the cartridges 11 can be mounted into the apparatus main assembly 3. Also in this embodiment, the image forming apparatus 1 is structured so that when the cartridges 11 are mounted into the cartridge compartment 3A, the cartridges 11 are raised in their entirety. Therefore, the image forming apparatus in this embodiment is more reliable than a conventional image forming apparatus, in terms of the state of contact between each drum 12 and belt 4*a* across the entire range in the lengthwise direction of the drum 12. Incidentally, in this embodiment, the state in which the cartridge 11 is in its preset image forming position in the apparatus main assembly 3 coincides with the state in which the drum 12 is in contact with the belt 4*a*.

Figure 8:
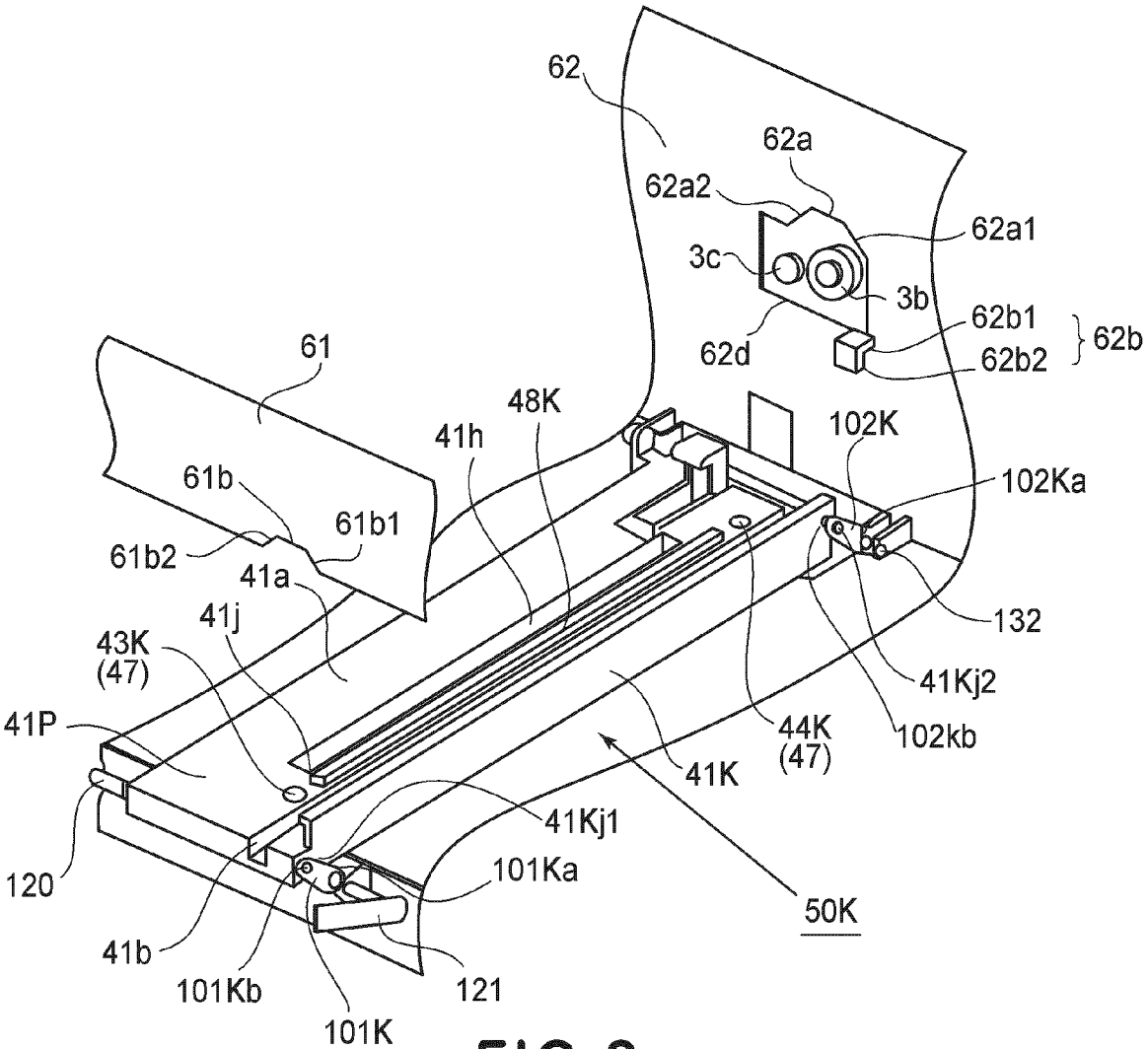
FIG. 8 is a perspective view of the cartridge supporting member elevator (mechanism for raising or lowering cartridge supporting member) when the cartridge supporting member is in its second position.
Figure 9:
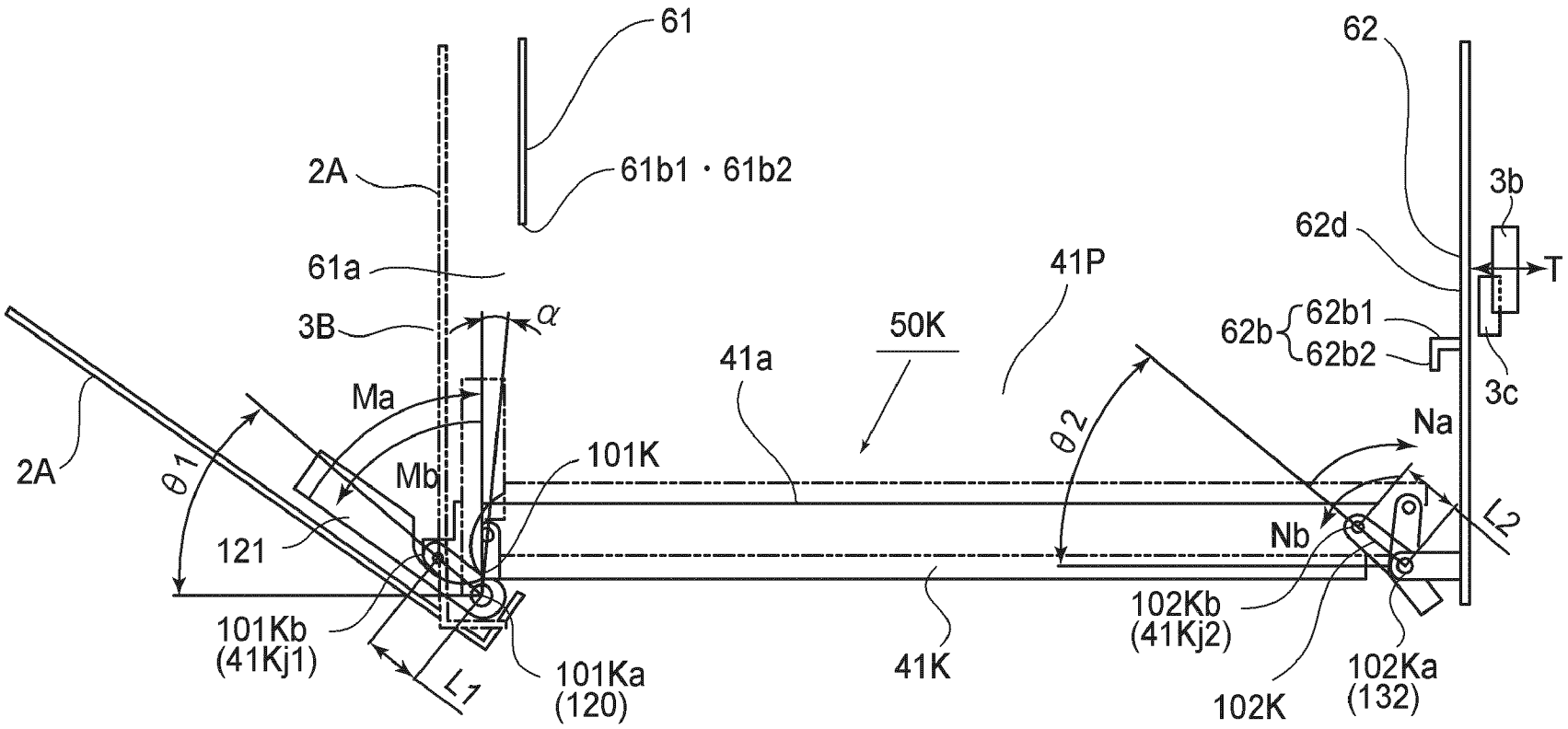
FIG. 9 is a drawing for showing the vertical movement of the cartridge supporting member.
Figure 10:
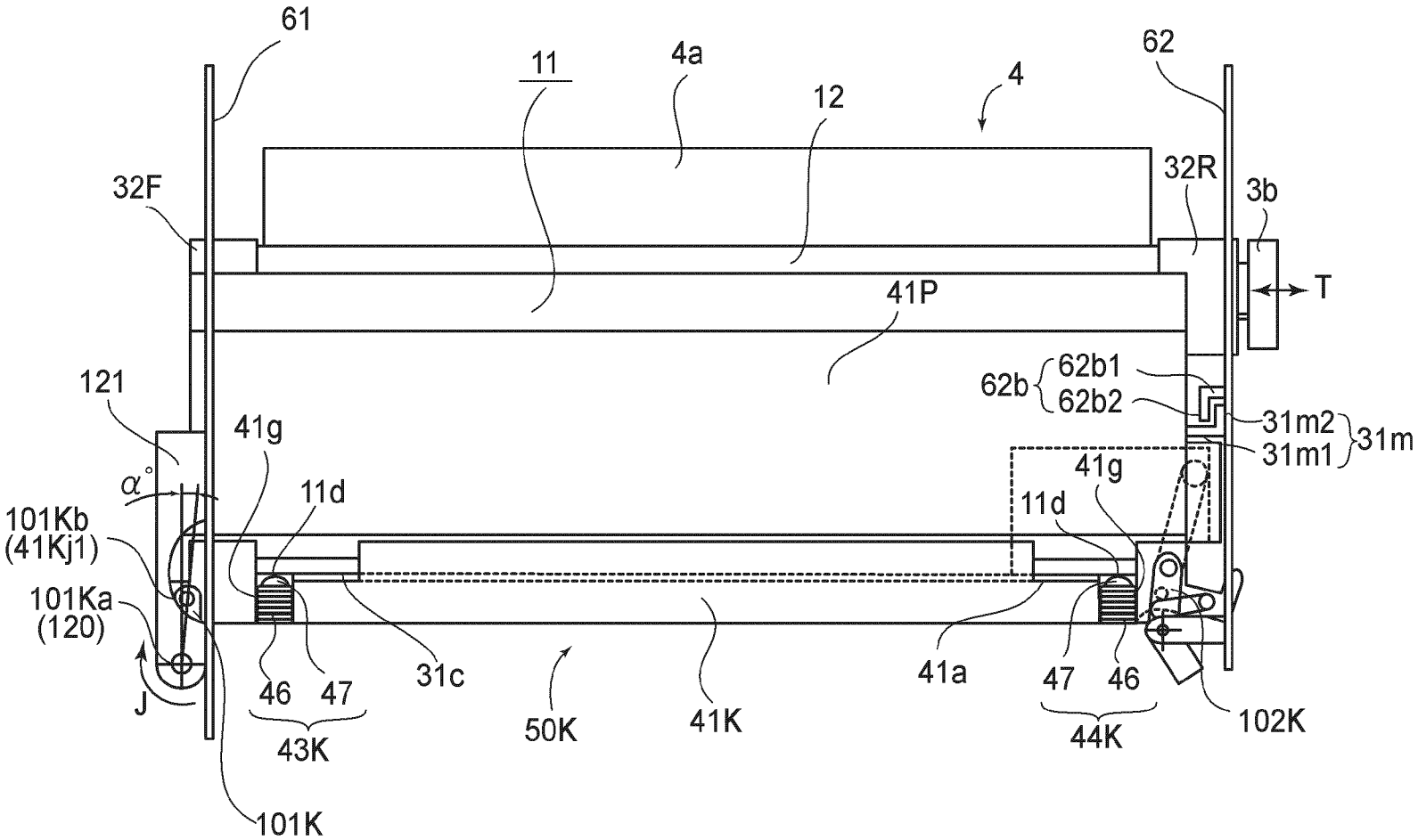
FIG. 10 is a drawing of the cartridge supporting member elevator when the cartridge supporting member is in its first position, in which the cartridge supporting member keeps the cartridge in the image forming position.

FIG. 8 is a perspective view of the elevator 50 of the supporting member 41, that is, the mechanism for raising or lowering the supporting member 41. FIG. 8 shows the elevator 50 from which the cartridges 11 has been removed. FIG. 9 is a side view of the supporting member 41 and elevator 50, and shows the upward and downward movement of the supporting member 41. Referring to FIG. 9, the contours of the supporting member 41, a rotationally movable member 101K, a rotationally movable member 102K, and internal door 2A when the cartridge 11K is in its second position in the apparatus main assembly 3, are drawn with solid lines, whereas the contours of the supporting member 41K, and rotationally movable members 101K and 102K when the cartridge 11K is in its first position in the apparatus main assembly 3, that is, after the cartridge 11K is positioned relative to the apparatus main assembly 3 in terms of the lengthwise direction of the cartridge 11K are drawn with double-dot chain lines. FIG. 10 is a sectional view of the elevator 50K of the supporting member 41, and the cartridge 11K, at a plane parallel to the lengthwise direction of the cartridge 11.

First, the structure of the supporting member 41 will be described. Incidentally, the cartridge supporting members 41 (41Y, 41M, 41C, and 41K) which support the cartridges 11 (11Y, 11M, 11C, and 11K), respectively are the same in structure. The supporting members 41Y, 41M, 41C, and 41K are four different portions of a single member. Thus, the four supporting members 41Y, 41M, 41C, and 41K move together upward or downward.

Referring to FIG. 6, the contour of the supporting member 41K as seen from its lengthwise direction roughly matches that of the bottom portion 31*h* of the cartridge 11K as seen from its lengthwise direction. The supporting member 41K is provided with a laser beam opening 41*h* (slit), which is roughly at the center of the supporting member 41K in terms of the widthwise direction of the supporting member 41K and extends in the lengthwise direction of the supporting member 41K. When the cartridge 11K is in a preset position on the supporting member 41K, the laser beam opening 41*h* aligns with the hole 31*d* of the bottom portion 31*h* of the cartridge 11K, allowing the beam of laser light L projected upward from the scanner unit 16 (FIG. 1) located below the supporting member 41K, to enter upward into the cartridge 11K (through the laser beam opening 41*h* and hole 31*d*), and illuminate the peripheral surface of the drum 12.

The supporting member 41K is provided with a cartridge guiding groove 41*b* and a cartridge guiding groove 41*f*, which are parallel to the laser beam opening 41*h*. That is, the guiding grooves 41*b* and 41*f* are parallel to the direction J in which the cartridge 11K is mounted into the apparatus main assembly 3. The guiding groove 41*b* is in the bottom surface 41*a* of the upwardly facing recess of the supporting member 41K. The guiding groove 41*f* is in the inward surface of the right lateral wall of the cartridge 11K.

When the cartridge 11 is mounted onto the supporting member 41, the cartridge guiding rib 31*e* with which the bottom portion 31*h* of the cartridge frame 31 (drum unit 15) is provided is to be fit into the guiding groove 41*b* so that the cartridge 11 is guided into the apparatus main assembly 3 by the combination of the guiding rib 31*e* and guiding groove 41*b*. In this embodiment, the guiding groove 41*b* is recessed in such a shape that it can accommodate the guiding rib 31*e*, which projects downward from the bottom wall of the cartridge frame 31 (drum unit 15). Further, when the cartridge 11 is mounted onto the supporting member 41, the vertical movement cartridge position regulating rib 31*f* which perpendicularly projects from the lateral surface of the bottom portion 31*h* of the cartridge frame 31 (drum unit 15) is to be fitted into the guiding groove 41*f* so that the cartridge 11 advances into the apparatus main assembly 3, with the rib 31*f* being guided by the groove 41*f*.

The supporting member 41K is provided with a pair of cartridge pressing members 43K and 44K which project upward from the front and rear end portions of the top surface 41*a* of the supporting member 41K, respectively. Referring to FIG. 10, each of the cartridge pressing members 43K and 44K is made up of a coil spring 46 and a pressure applying member 47, which are fitted in a vertical hole 41*g* cut in the supporting member 41K from the top surface 41*a* of the supporting member 41K. The resiliency of the coil spring 46 keeps the pressure applying member 47 slightly projecting above the top surface 41*a* of the supporting member 41K. The coil springs 46 are elastic members which belong to the apparatus main assembly 3.

The recess 41*j* of the supporting member 41K is provided with a rail 48K, the support portions 48*a* and 48*b* of which are embedded in a pair of through holes 41*n*1 and 41*n*2 cut downward from the bottom surface of the recess 41*j*, as shown in FIG. 7 (*b*). The support portions 48*a* and 48*b* project downward from the bottom surface of the rail 48K. That is, the rail 48K is supported so that it is vertically slidable in the supporting member 41K. When the supporting member 41K is in the second position, the bottom surfaces 48*a*1 and 48*b*1 of the support portion 48*a* and 48*b* of the rail 48K, respectively, are kept in contact with a bottom frame 63, which connects the front frame 61 and rear frame 62, by the weight of the rail 48K itself. In other words, the contact between the rail 48K and bottom frame 63 regulates the further downward movement of the rail 48K. Thus, the rail 48K projects from the supporting member 41K by a distance large enough for the top surface of the 48K to be level with the top end of the cartridge pressing member 47 of each of the pressure applying members 43K and 44K. Therefore, when the cartridge 11K is mounted onto, or removed from, the supporting member 41K while the supporting member 41K is in the second position, the rail 48K and pressure applying members 43K and 44K support the cartridge 11K by the contact area 31*c* of the cleaning unit frame 31.

Next, referring to FIG. 7(*c*), when the supporting member 41K is in its first position, the supporting member 41K is also in its highest position. Therefore, when the supporting member 41K is in the first position, there is no contact between the bottom surfaces 48*a*1 and 48*b*1 of the rail 48K, and bottom frame 63. In other words, as the supporting member 41K is moved into the first position, the rail 48K becomes cradled into the recess 41*j* of the supporting member 41K, and remains stored therein. Therefore, when the supporting member 41K is in the first position, each of the cartridge pressing members 47 remains in contact with the contact area 31*c* of the cleaning unit frame 31; the two cartridge pressing members 47 keep the bearing members 32F and 32R pressed upon the contact areas 61*b* and 62*b* (bearing member seats) of the apparatus main assembly 3, respectively. Therefore, each drum 12 is kept in contact with the belt 4*a*.

Thus, this embodiment ensures that each drum 12 is reliably placed in contact with the belt 4*a* and remains in contact with the belt 4*a*.

Incidentally, in this embodiment, the state in which the drum 12 in a given cartridge 11 is in contact with the belt 4*a* coincides with the state in which the cartridge 12 is in its image forming position in the apparatus main assembly 3.

Further, in this embodiment, the cartridge 11 has cartridge positioning portions 32Fa, 32Fb, 32Ra, and 32Rb (FIGS. 5(*a*) and 5(*b*)). The cartridge positioning portions 32Fa and 32Fb are at one of the lengthwise ends of the drum 12, and the cartridge positioning portions 32Ra and 32Rb are at the other lengthwise end of the drum 12. Further, they are positioned so that as the cartridge 11 is properly set in the image forming position in the cartridge compartment 3A, they will be on the top side of the cartridge 11. Further, the cartridge positioning portions 32Fa and 32Fb are portions of the bearing member 32F, and are located next to each other. The cartridge positioning portions 32Ra and 32Rb are portions of the bearing members 32R, and are located next to each other. Therefore, the cartridge positioning portions 32Fa, 32Fb, 32Ra, and 32Rb can precisely position the drum 12 in the apparatus main assembly 3.

On the other hand, the apparatus main assembly 3 is provided with cartridge positioning portions 61*b*1, 61*b*2, 62*a*1, 62*a*2 (FIGS. 8 and 11). The cartridge positioning portions 61*b*1 and 61*b*2 are two separate portions of the frame 61, and the cartridge positioning portions 62*a*1 and 62*a*2 are two separate portions of the frame 62.

Further, the cartridge 11 has a pair of contact areas lid (FIGS. 7(*b*), 7(*c*) and 10), by which the cartridge 11 receives the force generated by the springs 46 (elastic members with which apparatus main assembly 3 is provided) in the direction to keep the cartridge positioning portions 32Fa and 32Fb of the cartridge 11 upon the cartridge positioning portions 62*a*1 and 62*a*2 of the apparatus main assembly 3, and the cartridge positioning portions 32Ra and 32Rb of the cartridge 11 upon the cartridge positioning portion 61*a*1 and 61*a*2 of the apparatus main assembly 3, after the proper mounting of the cartridge 11 into the apparatus main assembly 3. The contact areas lid are located at the lengthwise ends of the cartridge 11, one for one, and are portions of the surface of the cartridge 11, which face downward when the cartridge 11 is in its image forming position in the apparatus main assembly 3.

Further, in this embodiment, the multiple cartridges 11, which are different in the color of the toner they store, can be moved upward all at once by the supporting members 41 to place the drum 12 in each cartridge 11 in contact with the belt 4*a* in order to make it possible for the toner image on each drum 12 can be transferred onto the belt 4*a*.

Next, the elevator 50K for vertically moving the supporting member 41K will be described regarding its structure. Referring to FIG. 8, the elevator 50K is made up of the, rotationally movable members 101K and 102K, a rotational shaft 120, a supporting shaft 132 (rotational shaft), and lever 121.

The shaft 120 (third axle) is positioned so that its right end is lower than the left end, with its angle relative to the horizontal direction being roughly the same as the angle θ of the abovementioned theoretical plane C. The shaft 120 is rotatably supported by the bearing members with which the front frame 61 is provided. It is roughly parallel to the internal door supporting rotational shaft 2E, and is higher in position than the internal door supporting rotational shaft 2E (FIG. 11).

The rotationally movable member 101*k* is supported by the frame 61 in such a manner that it can be rotated about the shaft 120 fitted in a first hole 101*k*a with which the rotationally movable member 101*k* is provided. The rotationally movable member 101*k* is solidly attached to the shaft 120, and therefore, it rotates with the shaft 120. Further, the rotationally movable member 101*k* is provided with a second hole 101Kb, in which the shaft 41Kj1 of the supporting member 41K, which is at the front end of the supporting member 41K, is rotatably fitted.

The rotationally movable member 102K is supported by the frame 62 in such a manner that it can be rotated about the shaft 132 fitted in a first hole 102Ka with which the rotationally movable member 102K is provided. Further, the rotationally movable member 102K is provided with a second hole 102Kb, in which the shaft 41Kj2 of the supporting member 41K, which is at the rear end of the supporting member 41K, is rotatably fitted. Incidentally, in the second hole 101Kb, the shaft 41Kj1 of the supporting member 41K is fitted to support the shaft 41Kj1 by the supporting member 41K. The shaft 120 is at the front end of the apparatus main assembly 3, and extends from the left end of the first supporting member 41, that is, the supporting member 41Y, to the right end of the fourth supporting member 41, that is, the supporting member 41K. The shaft 120 is in connection with the rotationally movable member 101 which supports the front end of the supporting member 41, in the cartridge compartment 3A. Further, the right end portion of the shaft 120 (which corresponds to right end of image forming apparatus) is provided with the lever 121, which was integrally formed with the shaft 120. Rotationally moving the lever 121 causes the shaft 120 to rotate, which in turn causes both rotationally movable members 101 and 102 to rotate together.

Referring to FIG. 9, an alphanumeric designation L1 represents the distance from the axial line of the first hole 101K, which coincides with the rotational axis of the rotationally movable member 101K, to the axial line of the second hole 101Kb in which the shaft 41Kj1 of the supporting member 41K is fitted. Similarly, an alphanumeric designation L2 represents the distance between the axial line of the first hole 1012Ka, which coincides with the rotational axis of the rotationally movable member 101K to the axial line of the second hole 102Kb in which the shaft 41Kj2 of the supporting member 41K is fitted to support the supporting member 41K by the rotationally movable member 102K. In this embodiment, L1 equals L2 (L1=L2). Further, θ1 is the angle between the straight line which connects the axial line of the first hole 101Ka of the rotationally movable member 101K and the axial line of the second hole 101Kb of the rotationally movable member 101K, and the horizontal line, when the supporting member 41K is in the second position (which is indicated by solid lines), which is the position in which the supporting member 41K allows the cartridge 11K to be mounted into, or removed from, the apparatus main assembly 3. Similarly, θ2 is the angle between the horizontal plane, and the flat plane which coincides with both the axial line of the first hole 102Ka of the rotationally movable member 102Ka, and axial line of the second hole 102Kb of the rotationally movable member 102K. In this embodiment, θ1 equals θ2 (θ1=θ2). The apparatus main assembly 3 is structured so that when the supporting member 41K is in the second position, in which it allows the cartridge 11K to be mounted into, or removed from, the apparatus main assembly 3, the top surface 41*a* of the supporting member 41K is level, that is, the front and rear side of the top surface 41*a* are at the same level (parallelepipedic linkage).

The lever 121, which is integral with the shaft 120, is rotationally movable in the direction indicated by an arrow mark Ma or Mb. As the lever 121 is rotationally moved in the direction indicated by the arrow mark Ma, the rotationally movable member 101K rotates in the direction indicated by the arrow mark Ma about the shaft 120 (axial line of first hole 101Ka), whereby the rotationally movable member 102K is rotationally moved about the shaft 132 (axial line of first hole 102Ka, in the direction indicated by an arrow mark Na. That is, as the supporting member 41K is moved from the second position to the first position, not only does it move rearward, but also, upward, while remaining horizontal. To describe in more detail, the horizontal component of this rotational movement of the supporting member 41K causes the supporting member 41K to move downstream in terms of the direction indicated by the arrow mark J in which the cartridge 11 is inserted (mounted). Contrarily, as the lever 121 is rotationally moved in the direction indicated by the arrow mark Mb, the rotationally movable member 101K rotationally moves in the direction indicated by the arrow mark Mb about the shaft 120 (axial line of first hole 101Ka), whereby the rotationally movable member 102K is rotationally moved in the direction indicated by an arrow mark Nb about the shaft 132 (axial line of first hole 102Ka). That is, as the supporting member 41K is moved from the first position to the second position, not only does it move frontward, but also, downward, while remaining horizontal. The horizontal component of this movement of the supporting member 41K coincides with the upward movement of the supporting member 41K in terms of the direction (cartridge mounting direction J) in which the cartridge 11 is inserted into the apparatus main assembly 3 (cartridge compartment 3A).

In this embodiment, the elevator 50 is structured so that when the rotationally movable member 101K is in its position which corresponds to the first position of the supporting member 41K, the plane coinciding with both the axial line of the first hole 101Ka, and the axial line of the second hole 101Kb, is not vertical; the plane is tilted rightward by α°. With the employment of this structural arrangement, while the supporting member 41K is in the first position, the combination of the weight of the cartridge 11, and the weight of the supporting member 41K itself, functions as a force which works in the direction to rotate the shaft 120 in the direction indicated by the arrow mark Ma. Therefore, even if the apparatus main assembly 3 vibrates for some reason or other, the supporting member 41K is prevented from moving to the second position. Therefore, it is ensured that unless the lever 121 is rotationally moved in the direction indicated by the arrow mark Mb, the supporting member 41K remains in the first position.

Incidentally, in the above, the structure of the elevator 50 was described with reference to the cartridge 11K. Obviously, it can be described with reference to any of the cartridges 11C, 11M, and 11K.

Referring to FIG. 11, in this embodiment, the internal door 2A is connected to the level 120. That is, the connective shaft 121*a* of the lever 121 is fitted in the slot 2F of the internal door 2A. Thus, the opening or closing movement of the internal door 2A rotationally moves the lever 121. Therefore, the opening movement of the external door 2 causes the lever 121 to rotate in the direction indicated by the arrow mark Mb, causing the supporting member 41K to move from the first position to the second position, because the internal door 2A is opened by the opening movement of the external door 2, and the lever 121 is moved in the direction indicated by the arrow mark Mb by the opening movement of the internal door 2A. Further, the closing movement of the external door 2 causes the lever 121 to rotate in the direction indicated by the arrow mark Ma, causing the supporting member 41K to move from the second position to the first position, because the internal door 2A is closed by the closing movement of the external door 2, and the lever 121 is moved in the direction indicated by the arrow mark Ma by the closing movement of the internal door 2A.

In this embodiment, the member to be operated by an operator to move the rotationally movable members 101 and 102 to vertically move the supporting member 41 while moving the supporting member 41 in the horizontal direction, is the external door 2. Thus, the supporting member 41 is moved by the opening or closing movement of the external door 2. In terms of the direction in which the cartridges 11 are inserted (mounted) into the apparatus main assembly 3, the external door 2 is on the upstream end of the apparatus main assembly 3. However, this setup is not mandatory. For example, the following setup may be employed: The image forming apparatus 1 is provided with a rotationally movable lever, as a supporting member moving lever, which is located at the front end of the main assembly 3 of the image forming apparatus 1. The rotational movement of this lever is transmitted to the shaft 120 through a driving force transmitting means, such as a gear (gears) to move the rotationally movable members 101 and 102 to move the supporting member 41. In the case of this example, as an operator rotationally moves the abovementioned lever after the insertion of the cartridge(s) 11 into the apparatus main assembly 3 in its lengthwise direction, the supporting member 41 is moved from the second position to the first position to complete the operation for mounting cartridge(s) 11 into the apparatus main assembly 3.

In this embodiment, an operator is to operate a supporting member moving member (for example, external door 2, or external lever). Moving the supporting member moving member causes all the cartridges 11 supported by the supporting members 41 to be moved together upward or downward. Therefore, the image forming apparatus 1 in this embodiment is superior to a conventional image forming apparatus, in terms of the efficiency regarding the operation for mounting the cartridge(s) 11 into the apparatus main assembly 3 or removing the cartridge(s) 11 from the apparatus main assembly 3.

<Method for Mounting Process Cartridge>

Next, the method for mounting the cartridge 11 into the apparatus main assembly 3 will be described. Referring to FIG. 3, an operator is to open the external door 2 in the direction indicated by an arrow mark Q (FIG. 4) by grasping the handhold portion 2*a* of the external door 2, exposing thereby the opening 61*a*, through which the cartridge(s) 11 in the apparatus main assembly 3 can be replaced. That is, it is through the opening 61*a* that the cartridge(s) 11 is mounted into, or removed from, the apparatus main assembly 3.

The internal door 2A facilitates the mounting of the cartridge 11 onto the supporting member 41 by the operator. More specifically, the internal door 2A is in connection to the supporting member 41, and is moved by the opening or closing movement of the external door 2 to expose or cover the cartridge compartment 3A in which the cartridge 11 is supported by the supporting member 41. That is, the internal door 2A is moved by the opening movement of the external door 2 into its open position in which it allows the supporting member 41 to partially support the cartridge 11 when the cartridge 11 is slid onto the supporting member 41 by the operator. To describe in more detail, when an operator places the cartridge 11 on the supporting member 41, the operator is to place the leading end of the cartridge 11, in terms of the direction in which the cartridge is mounted into the apparatus main assembly 3, on the supporting member 41, and rest the trailing end of the cartridge 11 on the internal door 2A (cartridge 11Y in FIG. 4), so that all that is necessary to be done thereafter to place the entirety of the cartridge 11 on the supporting member 41 is to simply push the cartridge 11 inward of the apparatus main assembly 3. In this embodiment, the apparatus main assembly 3 is provided with the internal door 2A. Therefore, the image forming apparatus 1 in this embodiment is superior to an image forming apparatus which does not have the internal door 2A, in terms of the ease (efficiency) with which an operator can slide the cartridge 11 onto the supporting member 41. The effects of this embodiment are particularly apparent when a heavy cartridge (11) is mounted into the apparatus main assembly 3.

Not only do the bearing members 32F and 32R of the cartridge 11 support the drum 12 as described above, but also, function as cartridge positioning members for correctly positioning the cartridge 11 relative to the apparatus main assembly 3. That is, referring to FIG. 7(*c*), as the supporting member 41 is moved from the second position into the first position while supporting the cartridges 11, the bearing members 32F comes into contact with the contact area 61*b* of the front frame 61, and the bearing member 32R comes into contact with the contact area 62*a* of the rear frame 62, whereby the cartridge 11 is correctly positioned relative to the apparatus main assembly 3. When the cartridge 11 is in this position, the drum 12 in the cartridge 11 is in contact with the belt 4*a*. As described above, the bearing members 32F and 32R are located at the lengthwise ends of the cleaning unit frame 31, one for one. Further, the axial line of the bearing member 32F and the axial line of the bearing member 32R coincide with the axial line of the drum 12. Therefore, as the cartridge 11 is properly positioned relative to the apparatus main assembly 3, the drum 12 becomes precisely positioned relative to the apparatus main assembly 3.

Further, when the supporting member 41 moves from the second position to the first position, it moves rearward, while remaining horizontal, from the front side in terms of the direction in terms of the direction in indicated by the arrow mark J, that is, the direction in which the cartridge 11 is mounted into the apparatus main assembly 3. It also moves upward while it moves from the second position to the first position. To describe in more detail, when the supporting member 41 moves rearward, it rubs against the contact area 31*c* of the cleaning unit frame 31. Therefore, there is a certain amount of friction Z between the supporting member 41 and contact area 31*c* (FIG. 7 (*c*)). Thus, the cartridge 11 is pushed rearward by this friction Z. Therefore, the cartridge 11 moves upward with the supporting member 41, with the contact area 31*j* and cartridge position regulating portion 62 rubbing against each other, ensuring that the cartridge 11 is precisely positioned relative to the apparatus main assembly 3. Incidentally, the heavier the cartridge 11 (for example, where cartridge size corresponds to recording medium size A3), the greater the friction. Therefore, this embodiment ensures that the cartridge 11 is reliably mounted regardless of its weight, that is, even if the cartridge 11 is very heavy. This is one of the virtues of this embodiment.

Also in this embodiment, as the external door 2 is closed, the supporting member 41 is moved both rearward and upward by the movement of the external door 2, from its frontmost position in the apparatus main assembly 3 while supporting the cartridges 11. On the other hand, as the external door 2 is opened, the supporting member 41 is moved both frontward and downward by the movement of the external door 2, from its rearmost position (highest position) while supporting the cartridges 11. Therefore, an operator is allowed to place the cartridge 11 on the supporting member 41 or remove it from the supporting member 41, from the front side of the apparatus main assembly 3. In other words, this embodiment can improve an image forming apparatus in terms of the efficiency with which the cartridge 11 can be mounted or dismounted. Incidentally, the front side of the apparatus main assembly 3 means where the external door 2 is located in terms of the direction parallel to the axial line of the drum 12.

Designated by a referential symbol 31*m* is an L-shaped hook with which the cartridge 11 is provided (FIGS. 5(*b*), 7(*b*), 7(*c*), and 10). The hook 31*m* is at the leading end of the unit 15 in terms of the cartridge mounting direction indicated by the arrow mark J. It is made up of a portion which perpendicularly (horizontally) projects from the end surface of the cartridge 11, and a portion which projects perpendicularly upward from the end of the horizontal portion.

Corresponding to the L-shaped hook 31*m* of the cartridge 11, the rear fame 62 of the apparatus main assembly 3 is provided with an L-shaped hook 62*b*, which is made up of a portion which perpendicularly (horizontally) projects inward from the rear frame 62, and a portion which projects downward from the end of the horizontal portion (FIGS. 7(*a*), 7(*c*), 8, 9, 10, and 11).

Therefore, as the cartridge 11 is moved diagonally upward by the movement of the supporting member 41 to be properly positioned relative to the apparatus main assembly 3, the L-shaped hook 31*m* becomes engaged with the L-shaped portion 62*b* (FIG. 7(*c*) and 10). Thus, when the cartridge 11 is in its highest position (image forming position) in the apparatus main assembly 3, the L-shaped portion 31*m* remains engaged with the L-shaped portion 62*b*, preventing the cartridge from moving in the direction in which the cartridge 11 is to be moved to be removed from the apparatus main assembly 3 (direction opposite from cartridge mounting direction indicated by arrow mark J).

Obviously, as the cartridge 11 is lowered, the L-shaped hook 31*m* becomes disengaged from the L-shaped hook 62*b*, allowing the cartridge 11 to be extracted from supporting member 41.

As described above, the apparatus main assembly 3 is provided with the L-shaped hook 62*b* which is solidly attached to the apparatus main assembly 3, whereas the cartridge 11 is provided with the L-shaped portion 31*m*, which is located at the leading end of the cartridge 11 in terms of the direction indicated by the arrow mark J, in which the cartridge 11 is mounted into the apparatus main assembly 3, that is, the direction parallel to the lengthwise direction of the drum 12. When the cartridge 11 is in its image forming position in the apparatus main assembly 3, the L-shaped portion 31*m* remains engaged with the L-shaped portion 62*b*, preventing the cartridge 11 from moving in the opposite direction from the direction indicated by the arrow mark J, that is, the cartridge mounting direction. The L-shaped portion 31*m* becomes engaged with the L-shaped portion 62*b* while the supporting member 41 is moved upward. The L-shaped portion 31*m* becomes separated from the L-shaped portion 62*b* while the supporting member 41 is moved downward.

The L-shaped portion 31*m* has a first portion 31*m*1 which perpendicularly (horizontally) projects from the end surface of the cartridge 11, and a second portion 31*m*2 which projects perpendicularly upward from the end of the horizontal portion 31*m*1.

The L-shaped hook 62*b* has a first portion 62*b*1 which perpendicularly (horizontally) projects inward from the rear frame 62, and a second portion 62*b*2 which projects downward from the end of the horizontal portion 62*b*1.

Thus, the second portion 31*m*2 of the L-shaped hook 31*m*, and the second portion 62*b*2 of the L-shaped hook 62*b*, becomes engaged with each other to prevent the frontward movement of the cartridge 11.

The apparatus main assembly 3 is provided with the abovementioned rear frame, which is at the downstream end of the apparatus main assembly 3 in terms of the direction indicated by the arrow mark J, that is, the direction in which the cartridge 11 is mounted into the apparatus main assembly 3. The rear frame functions as the cartridge position regulating portion 62. The rear frame 62 is provided with an opening 62*d*. Thus, as an operator pushes the cartridge 11 into the apparatus main assembly 3 deep enough for the contact area 31*j* (cartridge position regulating portion) of the cartridge 11 to come into contact with the rear frame 62, in order to support the cartridge 11 with the supporting member 41, the drum coupling 34, by which the cartridge 11 receives from the apparatus main assembly 3 the rotational driving force for rotating the drum 12, projects downstream in terms of the cartridge mounting direction, from the rear frame 62 through the opening 62*d* (FIGS. 7(*b*) and (*c*)), and also, the development roller coupling 35, by which the cartridge 11 receives from the apparatus main assembly 3 the rotational driving force for rotating the development roller 71, projects downstream from the cartridge 11 through the opening 62*d*. Further, as the supporting member 41 is moved upward, with the cartridge position regulating portion 31*j* of the cartridge 11 sliding on (rubbing) the inward surface of the rear frame 62 (cartridge position regulating portion), the bearing member 32F comes into contact (collides) with the frame 61, and the bearing member 32R comes into contact (collides) with the frame 62.

During the above described movement of the supporting member 41 (hence, movement of cartridge 11), the resiliency of the springs 46 (elastic member of apparatus main assembly 3) contribute to keeping the cartridge 11 pressed upward.

Also during the above described movement of the supporting member 41, the cartridge 11 is precisely positioned in the apparatus main assembly 3. That is, as the external door 2 is closed, the cartridge 11 is completely positioned in the apparatus main assembly 3. Further, the drum coupling 3*b* of the apparatus main assembly 3 is moved by the movement of the external door 2 in the direction indicated by an arrow mark J. Thus, as the external door 2 is closed, the drum coupling 34 is made to engage with the drum coupling 3*b* of the apparatus main assembly 3*b* by the movement of the external door 2, and also, the development roller coupling 35 is made to engage with the developer coupling 3*c* of the apparatus main assembly 3 by the upward movement of the cartridge 11. Thus, the drum 12 and development roller 71 are enabled to rotate by receiving rotational driving force from the apparatus main assembly 3.

When the cartridge 11 is moved out of the apparatus main assembly 3, the above described operational sequence occurs in reverse. That is, as the external door 2 is opened, the movement of the external door 2 causes the couplings 34 and 3*b* to separate from each other by the movement of the external door 2, and also, causes the supporting member 41 to move both frontward and downward while remaining horizontal. Thus, as the external door 2 is opened, the bearing member 32F separates from the frame 61, and the bearing member 32R separates from the frame 62. Further, the coupling 35 separates from the coupling 3*c*.

Incidentally, in this embodiment, as an operator pushes the cartridge 11 into the apparatus main assembly 3 deep enough for the cartridge position regulating member 31*j* to come into contact with the abovementioned rear frame 62, the drum coupling 34 and development roller coupling 35 project downstream, in terms of the abovementioned cartridge mounting direction, from the frame 62 through the opening 62*d*, as described above, ensuring that the drum coupling 34 engages with the drum coupling 3*b* of the apparatus main assembly 3, and also, that the development roller coupling 35 engages with the development roller coupling of the apparatus main assembly 3.

Also in this embodiment, the rear frame 62, that is, one of the cartridge position regulating portions, is provided with the opening 62*d*. Therefore, the positional relationship between the cartridge position regulating portion 62 and opening 62*d* in this embodiment is more precise than the counterpart in a conventional image forming apparatus. Comparing to an image forming apparatus, the opening 62*d* of which is not a part of the cartridge position regulating portion 62, the image forming apparatus 1 in this embodiment can be more easily, and therefore, more efficiently, assembled.

However, this embodiment is not intended to limit the present invention in the structure of an image forming apparatus. That is, the opening 62*d* does not need to be a part of the cartridge position regulating portion 62 (rear frame 62).

[Embodiment 2]

Figure 12:
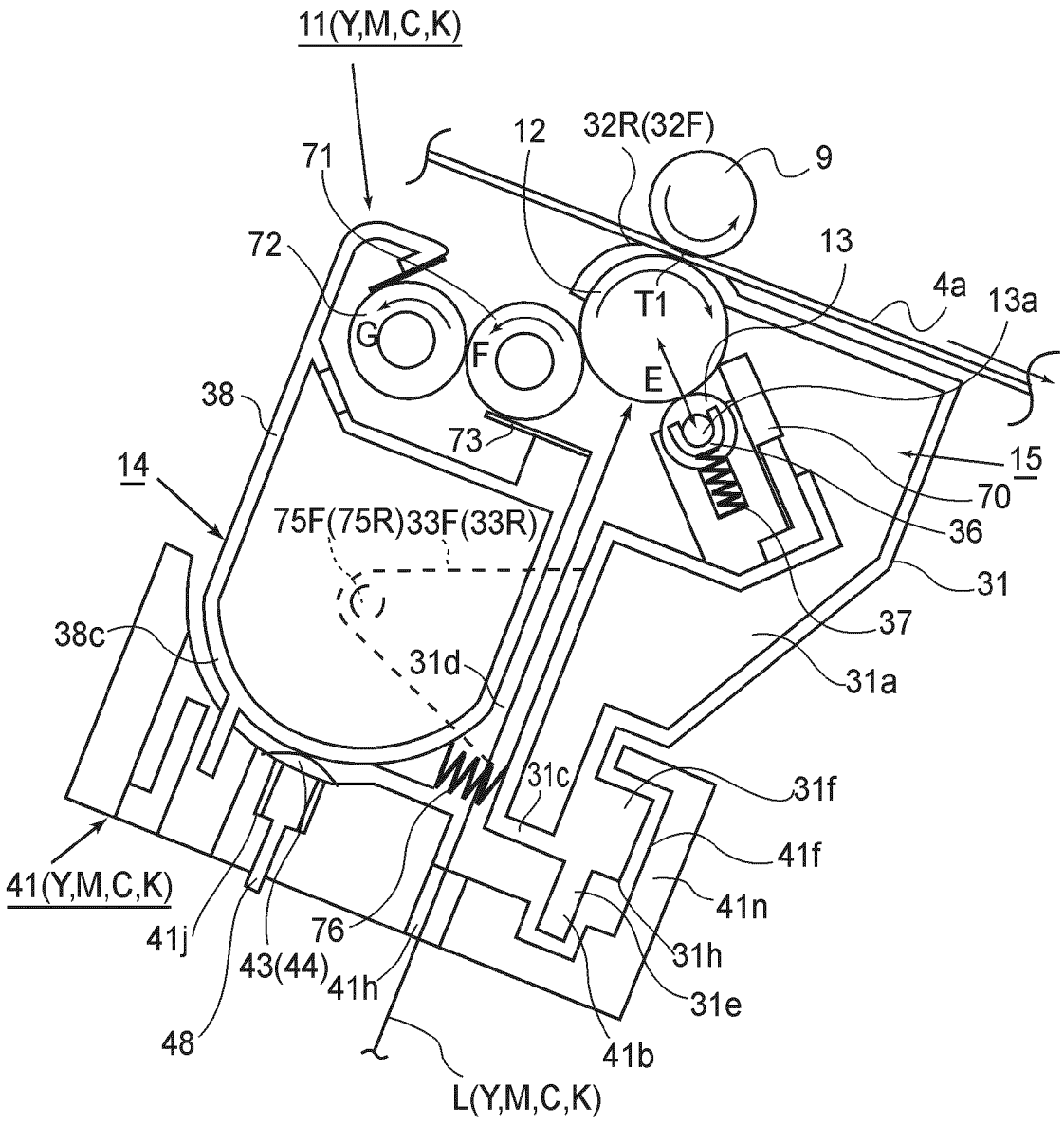
FIG. 12 is an enlarged schematic sectional view of one of the cartridges in its image forming position in the main assembly of the image forming apparatus in the second embodiment, and the adjacencies of the cartridge.

Referring to FIG. 12, in this embodiment, the frame 38 of the development unit 14 is provided with a support portion 38*c*. Further, the supporting member 41, with which the apparatus main assembly 3 is provided, roughly matches the support portion 38*c* of the development unit 14 in shape and size. Otherwise, the image forming apparatus in this embodiment is roughly the same in structure as that in the first embodiment.

As the cartridge 11 is inserted into the apparatus main assembly 3 in such a manner that the lengthwise direction of the cartridge 11 becomes parallel to the front-to-rear direction of the apparatus main assembly 3, the cartridge 11 is supported by the supporting member 41, by the support portion 38*c* of the cartridge 11. As the external door 2 is closed, the supporting member 41 in this embodiment also moves from its second position to the first position in the same manner as that in the first embodiment. That is, while the cartridge 11 is moved upward, that is, until the operation for mounting the cartridge 11 is completed, the supporting member 41 continuously rubs against the support portion 38*c*, and the cartridge position regulating portion 31*j* continuously rubs against the cartridge position regulating portion 62.

More specifically, the supporting member 41 slides on (rubs against) the support portion 38*c* of the development unit frame 38. Therefore, while the cartridge 11 is inserted into the apparatus main assembly 3, there is a certain amount of friction Z between the supporting member 41 and support portion 38*c*. This friction Z provides the cartridge 11 with the force which works in the direction to move the cartridge 11 rearward. Therefore, the cartridge position regulating portion 31*j* and cartridge position regulating portion 62 move upward with the supporting member 41 while sliding (rubbing) against each other, ensuring that the cartridge 11 is accurately positioned in the apparatus main assembly 3.

The apparatus main assembly 3 is provided with a pair of pressure applying members 43 and 44, which coincide in location with the front and rear end portions of the supporting member 41, one for one. As the supporting member 41 is moved into the first position, the pressure applying members 43 and 44 come into contact with the support portion 38*c* of the development unit frame 38, and press the cartridge 11 in the direction to place the drum 12 in contact with the belt 4*a* (FIG. 7(*c*)).

The above described structure of the image forming apparatus in this embodiment offers the same effects as those provided by the image forming apparatus in the first embodiment. That is, even if the cartridge 11 is not kept rigidly positioned relative to the apparatus main assembly 3 during the mounting of the cartridge 11, the cartridge 11 is reliably positioned in the apparatus main assembly 3 by the end of the cartridge mounting operation.

In the case of the image forming apparatuses in the preceding embodiments described above, when the cartridge 11 is mounted into the apparatus main assembly 3, each cartridge 11 is moved upward in entirety, whereby the cartridge 11 is precisely moved into its final position in the apparatus main assembly 3. Therefore, the cartridge 3 is accurately positioned in the apparatus main assembly 3.

The image forming apparatuses in the preceding embodiments are structured so that when the cartridge 11 is mounted into the apparatus main assembly 3, it is moved upward in entirety. Therefore, the image forming apparatuses are superior to a conventional image forming apparatus, in terms of the ease with which the cartridge 3 can be mounted into the apparatus main assembly 3.

Further, because the image forming apparatuses in the preceding embodiments are structured so that when the cartridge 11 is mounted into the apparatus main assembly 3, it is moved upward in entirety, it is ensured that the cartridge 11 is precisely mounted into its preset image forming position in the apparatus main assembly 3.

Further, the image forming apparatuses in the preceding embodiments are simpler in the structure for mounting the cartridge 11 into the apparatus main assembly 3. Therefore, they are lower in cost.

Further, the image forming apparatuses in the preceding embodiment are structured so that when multiple cartridges 11 are mounted into the apparatus main assembly 3, they are moved upward together in their entirety. Therefore, it is ensured that the drum 12 in each cartridge 11 comes into contact, and remains in contact, with the transfer belt 4*a* in a satisfactory manner.

[Miscellanies]

1) The apparatus main assembly 3 can be reduced in horizontal dimension by structuring it so that multiple cartridges 11 are arranged in tandem in a vertically slanted straight line as the image forming apparatuses in the first and second embodiments are structured. However, the application of the present invention is not limited to image forming apparatuses structured as those in the first embodiments. That is, the present invention can also be applied to an image forming apparatus structured so that multiple cartridges 11 are arranged in tandem in a horizontal straight line in the main assembly of the image forming apparatus.

2) The present invention is also applicable to a monochromatic image forming apparatus which employs only a single cartridge 11, and also, is applicable to a cartridge employed by the monochromatic image forming apparatus.

3) The present invention is also applicable to an image forming apparatus which does not have the internal door 2A. While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 135017/2008 filed May 23, 2008 which is hereby incorporated by reference.

What is claimed is:

1. A process cartridge detachably mountable to a main assembly of an electrophotographic image forming apparatus, wherein the electrophotographic image forming apparatus includes a supporting member, a movable member for moving the supporting member in a horizontal direction and in upward and downward directions, an operating member for moving the movable member, and a regulating portion, said process cartridge comprising:

an electrophotographic photosensitive drum;

process means actable on said electrophotographic photosensitive drum;

a portion-to-be-supported for being supported by the supporting member when said process cartridge is mounted to the main assembly of the apparatus in a longitudinal direction of said electrophotographic drum; and a portion-to-be-regulated for being regulated by being contacted by the regulating portion to regulate movement of said process cartridge in the longitudinal direction of said electrophotographic drum, when the supporting member is moved, by movement of the movable member by operation of the operating member and in the horizontal direction and in the upward direction while supporting said process cartridge, wherein, when the supporting member is moved in the horizontal direction and upward direction while supporting said process cartridge, said portion-to-be-supported slides on the supporting member in the horizontal direction, and said portion-to-be-regulated slides on the regulating portion in the upward direction.

2. A process cartridge according to claim 1, wherein said process cartridge is mounted to the main assembly of the apparatus in the longitudinal direction of said electrophotographic photosensitive drum, and said process cartridge further comprises a cartridge side locking portion, which is provided at a leading end portion of said process cartridge with respect to a mounting direction of said process cartridge, and which is engageable with a main assembly side locking portion to prevent movement of said process cartridge in a direction opposite the mounting direction.

3. An electrophotographic image forming apparatus for forming an image on a recording material, to which apparatus a process cartridge is detachably mountable, said electrophotographic image forming apparatus comprising:

(1) a supporting member;

(2) a movable member for moving said supporting member in a horizontal direction and upward and downward directions;

(3) an operating member for moving said movable member;

(4) a regulating portion; and (5) a process cartridge including:

an electrophotographic photosensitive drum, process means actable on said electrophotographic photosensitive drum, a portion-to-be-supported for being supported by said supporting member when said process cartridge is mounted to a main assembly of the apparatus, a portion-to-be-regulated for being regulated by being contacted by said regulating portion to regulate movement of said process cartridge in the horizontal direction, when said supporting member is moved, by movement of said movable member by operation of said operating member and in the horizontal direction and the upward direction while supporting said process cartridge, wherein, when said supporting member is moved in the horizontal direction and upward direction while supporting said process cartridge, said portion-to-be-supported slides on said supporting member, and said portion-to-be-regulated slides on said regulating portion.

4. An apparatus according to claim 3, wherein said process cartridge is mounted to said main assembly of the apparatus in a longitudinal direction of said electrophotographic photosensitive drum, and said process cartridge further includes a cartridge side locking portion, which is provided at a leading end portion of said process cartridge with respect to the mounting direction, and which is engageable with a main assembly side locking portion to prevent movement of said process cartridge in a direction opposite the mounting direction.

5. An apparatus according to claim 4, wherein said operating member includes an openable member for openably closing an opening, and wherein, when said supporting member moves in the horizontal direction in interrelation with a closing operation of said openable member, said supporting member moves in the mounting direction.

6. An apparatus according to claim 4, wherein said operating member includes an opening and closing door provided at an upstream position with respect to the mounting direction in said main assembly of the apparatus.

7. An apparatus according to claim 5, wherein said main assembly of the apparatus further includes a main assembly side positioning portion for positioning said process cartridge to said main assembly of the apparatus, and said supporting member includes a main assembly side elastic member for urging said process cartridge toward said main assembly side positioning portion when said process cartridge is set in said main assembly of the apparatus.

8. A process cartridge detachably mountable to a main assembly of an electrophotographic image forming apparatus, wherein the electrophotographic image forming apparatus includes a supporting member, a movable member for moving the supporting member in a horizontal direction and in upward and downward directions, an operating member for moving the movable member, a regulating portion, a main assembly side positioning portion, and a main assembly side elastic member, said process cartridge comprising:

an electrophotographic photosensitive drum;

process means actable on said electrophotographic photosensitive drum;

a portion-to-be-positioned provided on an upper side of process cartridge, in a state that process cartridge is set in the main assembly of the apparatus, at each of one and the other longitudinal ends of said electrophotographic photosensitive drum;

a portion-to-be-supported for being supported by the supporting member when said process cartridge is mounted to the main assembly of the apparatus in a longitudinal direction of said electrophotographic drum;

a portion-to-be-regulated, provided at a leading part of said process cartridge with respect to a mounting direction in which said process cartridge is mounted to the main assembly of the apparatus, for being regulated by being contacted by the regulating portion to regulate movement of said process cartridge in the longitudinal direction of said electrophotographic drum, when the supporting member is moved, by movement of the movable member by operation of the operating member and in the horizontal direction and the upward direction while supporting said process cartridge;

a portion-to-be-urged for receiving a force from the main assembly side elastic member so as to be urged by the main assembly side positioning portion in a state that process cartridge is set in the main assembly of the apparatus, said portion-to-be-urged being provided on a lower surface of said process cartridge in the state that process cartridge is set in the main assembly of the apparatus, at each of one and the other ends of said process cartridge, wherein, when the supporting member is moved in the horizontal direction and upward direction while supporting said process cartridge, said portion-to-be-supported slides on the supporting member in the horizontal direction, and said portion-to-be-regulated slides on the regulating portion in the upward direction.

9. A process cartridge according to claim 8, wherein said process cartridge is mounted to the main assembly of the apparatus in the longitudinal direction of said electrophotographic photosensitive drum, and said process cartridge further comprises a cartridge side locking portion, which is provided at a leading end portion of said process cartridge with respect to a mounting direction of said process cartridge, and which is engageable with a main assembly side locking portion to prevent movement of said process cartridge in a direction opposite the mounting direction.

10. A color electrophotographic image forming apparatus for forming an image on a recording material, to which apparatus a process cartridge is detachably mountable, said electrophotographic image forming apparatus comprising:

(1) a supporting member;

(2) a movable member for moving said supporting member in a horizontal direction and upward and downward directions;

(3) an opening for permitting said process cartridge to pass when said process cartridge is mounted to or dismounted from a main assembly of the apparatus of said electrophotographic image forming apparatus;

(4) an openable member for openably closing said opening in interrelation with said movable member;

(5) an inside openable member, provided on said supporting member, for opening and closing a supporting portion for supporting said process cartridge in interrelation with an opening and closing operation of said openable member, wherein said inside openable member supports a part of said process cartridge when said openable member is moved to an opening position in interrelation with an opening operation, and said process cartridge is set on said supporting member;

(6) a regulating portion;

(7) a main assembly side positioning portion;

(8) a main assembly side elastic member; and (9) a process cartridge including:

an electrophotographic photosensitive drum, process means actable on said electrophotographic photosensitive drum, a portion-to-be-positioned provided on an upper side of said process cartridge, in a state that said process cartridge is set in said main assembly of the apparatus, at each of one and the other longitudinal ends of said electrophotographic photosensitive drum, a portion-to-be-supported for being supported by said supporting member when said process cartridge is mounted to said main assembly of the apparatus, a portion-to-be-regulated, provided at a leading part of said process cartridge with respect to a mounting direction in which said process cartridge is mounted to said main assembly of the apparatus, for being regulated by being contacted by said regulating portion to regulate movement of said process cartridge in the horizontal direction, when said supporting member is moved, by movement of the movable member by operation of the operating member and in the horizontal direction and the upward direction while supporting said process cartridge, a portion-to-be-urged for receiving a force from said main assembly side elastic member so as to be urged by said main assembly side positioning portion in a state that said process cartridge is set in said main assembly of the apparatus, said portion-to-be-urged being provided on a lower surface of said process cartridge in the state that said process cartridge is set in said main assembly of the apparatus, at each of one and the other ends of said process cartridge, wherein, when said supporting member is moved in the horizontal direction and upward direction while supporting said process cartridge, said portion-to-be-supported slides on said supporting member, and said portion-to-be-regulated slides on said regulating portion.

11. An apparatus according to claim 10, wherein said process cartridge is mounted to said main assembly of the apparatus in a longitudinal direction of said electrophotographic photosensitive drum, and said process cartridge further comprises a cartridge side locking portion which is provided at a leading end portion of said process cartridge with respect to the mounting direction and which is engageable with a main assembly side locking portion to prevent movement of said process cartridge in a direction opposite the mounting direction, and wherein, in a process of an upward movement of said supporting member, said cartridge side locking portion is engaged with said main assembly side locking portion, and in a process of a downward movement of said supporting member, said cartridge side locking portion is disengaged from said main assembly side locking portion.

12. An apparatus according to claim 11, wherein said supporting member is capable of moving in the upward direction while carrying a plurality of process cartridges including different color developers, and said photosensitive drums of said process cartridges are contacted to a transfer belt.

13. An apparatus according to claim 12, wherein said main assembly of the apparatus is provided with a rear frame functioning as said regulating portion at a position downstream of said supporting member with respect to the mounting direction, and said rear frame is provided with a frame opening, wherein, when said process cartridge is pushed to such an extent that said portion-to-be -regulated is brought into contact to said rear frame, a drum rotating force receiving portion for receiving a rotational force for rotating said electrophotographic photosensitive drum and a developing roller rotating force receiving portion for receiving a rotational force for rotating a developing roller are projected downstream through said frame opening with respect to the mounting direction.

14. A process cartridge detachably mountable to a main assembly of an electrophotographic image forming apparatus, wherein the electrophotographic image forming apparatus includes:

a supporting member capable of supporting said process cartridge and movable relative to the main assembly between a mounting and demounting position in which said process cartridge is mountable to and demountable from the supporting member and a mounted position in which said process cartridge is positioned in an image forming position relative to the main assembly; and a regulating portion, said process cartridge comprising:

an electrophotographic photosensitive drum;

a portion-to-be-supported for being supported by the supporting member when said process cartridge is mounted to the supporting member along a longitudinal direction of said electrophotographic photosensitive drum; and a portion-to-be-regulated for contacting the regulating portion to regulate movement of said process cartridge in the longitudinal direction when the supporting member moves from the mounting and demounting position to the mounted position in a state that said supporting member supports said process cartridge, wherein, when the supporting member moves from the mounting and demounting position to the mounted position in a state that the supporting member supports said process cartridge, said portion-to-be-supported slides on the supporting member and said portion-to-be-regulated slides on the regulating portion.

15. A process cartridge according to claim 14, further comprising, at a leading end of said process cartridge with respect to a mounting direction of said process cartridge, a cartridge side locking portion engageable with a main assembly side locking portion provided in the main assembly to regulate movement of said process cartridge in a direction opposite to the mounting direction in a state that the supporting member is in the mounted position.

16. An electrophotographic image forming apparatus for forming an image on a recording material, wherein a process cartridge is detachably mountable to said apparatus, said apparatus comprising:

(1) a supporting member capable of supporting said process cartridge and movable relative to a main assembly of said apparatus between a mounting and demounting position in which said process cartridge is mountable to and demountable from said supporting member and a mounted position in which said process cartridge is positioned in an image forming position relative to the main assembly;

(2) a regulating portion; and (3) a process cartridge including:

an electrophotographic photosensitive drum;

a portion-to-be-supported for being supported by said supporting member when said process cartridge is mounted to said supporting member along a longitudinal direction of said electrophotographic photosensitive drum; and a portion-to-be-regulated for contacting said regulating portion to regulate movement of said process cartridge in the longitudinal direction when said supporting member moves from the mounting and demounting position to the mounted position in a state that said supporting member supports said process cartridge, wherein, when said supporting member moves from the mounting and demounting position to the mounted position in a state that said supporting member supports said process cartridge, said portion-to-be-supported slides on said supporting member and said portion-to-be -regulated slides on said regulating portion.

17. An apparatus according to claim 16, further comprising, at a leading end of said process cartridge with respect to a mounting direction of said process cartridge, a cartridge side locking portion engageable with a main assembly side locking portion provided in the main assembly to regulate movement of said process cartridge in a direction opposite to the mounting direction in a state that said supporting member is in the mounted position.

18. An apparatus according to claim 16, wherein further comprising an opening for permitting said process cartridge to be mounted to or demounted from the main assembly, and an openable door capable of moving said supporting member from the mounting and demounting position to the mounted position in interrelation with a closing operation of said openable door.

* * * * *